US007752772B2

(12) United States Patent
Hatfield et al.

(10) Patent No.: US 7,752,772 B2
(45) Date of Patent: Jul. 13, 2010

(54) ARTICLE OF FOOTWEAR HAVING A FLUID-FILLED CHAMBER WITH FLEXION ZONES

(75) Inventors: Tobie D. Hatfield, Lake Oswego, OR (US); K. Pieter Hazenberg, Portland, OR (US)

(73) Assignee: Nike, Inc., Beaverton, OR (US)

( * ) Notice: Subject to any disclaimer, the term of this patent is extended or adjusted under 35 U.S.C. 154(b) by 945 days.

(21) Appl. No.: 11/523,769

(22) Filed: Sep. 19, 2006

(65) Prior Publication Data

US 2007/0169376 A1 Jul. 26, 2007

Related U.S. Application Data

(63) Continuation-in-part of application No. 11/338,601, filed on Jan. 24, 2006, now Pat. No. 7,555,851.

(51) Int. Cl.
*A43B 13/20* (2006.01)

(52) U.S. Cl. ..... 36/29

(58) Field of Classification Search ..... 36/29, 36/35 B, 153, 154
See application file for complete search history.

(56) References Cited

U.S. PATENT DOCUMENTS

| | | | |
|---|---|---|---|
| 500,385 | A | 6/1893 | Hall |
| 2,155,166 | A | 4/1939 | Kraft |
| 2,188,168 | A | 1/1940 | Winkel |
| 2,224,590 | A | 12/1940 | Boivin |
| 3,087,261 | A | 4/1963 | Russell |
| 3,683,431 | A | 8/1972 | Pennel et al. |
| 4,059,910 | A | 11/1977 | Bryden et al. |
| 4,183,156 | A | 1/1980 | Rudy |
| 4,219,945 | A | 9/1980 | Rudy |
| 4,241,524 | A | 12/1980 | Sink |
| 4,265,032 | A | 5/1981 | Levine |
| 4,287,250 | A | 9/1981 | Rudy |
| 4,302,892 | A | 12/1981 | Adamik |
| 4,309,831 | A | 1/1982 | Pritt |
| 4,309,832 | A | 1/1982 | Hunt |
| 4,638,577 | A | 1/1987 | Riggs |
| D288,027 | S | 2/1987 | Tonkel |
| D294,537 | S | 3/1988 | Le |

(Continued)

FOREIGN PATENT DOCUMENTS

| | | | |
|---|---|---|---|
| EP | 0687425 | A1 | 12/1995 |

(Continued)

OTHER PUBLICATIONS

International Search Report, mailed Dec. 13, 2007, for PCT application PCT/US2007/076874.

*Primary Examiner*—Ted Kavanaugh
(74) *Attorney, Agent, or Firm*—Plumsea Law Group, LLC

(57) ABSTRACT

An article of footwear is disclosed that includes a fluid-filled chamber with one or more flexion zones. The flexion zones may be areas of the chamber where a tensile element, for example, is absent, or the flexion zones may be areas of the chamber where opposite surfaces of the chamber are bonded together. The footwear may also include a sole structure with a flexion zone, and the flexion zone of the chamber may be aligned with the flexion zone of the sole structure. In other configurations, the chamber may include a chamber secured within a depression of a midsole of the footwear.

12 Claims, 33 Drawing Sheets

U.S. PATENT DOCUMENTS

| | | | | | |
|---|---|---|---|---|---|
| D294,653 | S | | 3/1988 | Le | |
| 4,906,502 | A | | 3/1990 | Rudy | |
| 4,908,964 | A | | 3/1990 | Deem | |
| 4,936,029 | A | | 6/1990 | Rudy et al. | |
| 5,083,361 | A | | 1/1992 | Rudy | |
| RE34,102 | E | * | 10/1992 | Cole et al. | 36/28 |
| 5,295,314 | A | * | 3/1994 | Moumdjian | 36/29 |
| 5,572,804 | A | | 11/1996 | Skaja et al. | |
| D378,472 | S | | 3/1997 | Bramani | |
| D396,342 | S | | 7/1998 | Foxen et al. | |
| 5,784,808 | A | | 7/1998 | Hockerson | |
| 5,915,820 | A | | 6/1999 | Kraeuter et al. | |
| 5,956,869 | A | * | 9/1999 | Kim | 36/29 |
| 5,976,451 | A | | 11/1999 | Skaja et al. | |
| 5,987,781 | A | | 11/1999 | Pavesi et al. | |
| 5,993,585 | A | | 11/1999 | Goodwin et al. | |
| 6,029,962 | A | | 2/2000 | Shorten et al. | |
| D421,832 | S | | 3/2000 | Loveder | |
| 6,065,230 | A | | 5/2000 | James | |
| 6,079,126 | A | | 6/2000 | Olszewski | |
| 6,098,313 | A | | 8/2000 | Skaja | |
| 6,115,945 | A | | 9/2000 | Ellis et al. | |
| 6,119,371 | A | | 9/2000 | Goodwin et al. | |
| 6,205,682 | B1 | | 3/2001 | Jong-Yeong | |
| 6,412,196 | B1 | * | 7/2002 | Gross | 36/102 |
| 6,453,577 | B1 | * | 9/2002 | Litchfield et al. | 36/29 |
| 6,487,795 | B1 | | 12/2002 | Ellis, III | |
| 6,754,981 | B1 | * | 6/2004 | Edwards | 36/29 |
| 7,080,467 | B2 | * | 7/2006 | Marvin et al. | 36/29 |
| 2001/0011427 | A1 | | 8/2001 | Seydel et al. | |
| 2003/0046830 | A1 | | 3/2003 | Ellis, III | |
| 2007/0169376 | A1 | * | 7/2007 | Hatfield et al. | 36/29 |

FOREIGN PATENT DOCUMENTS

| | | | |
|---|---|---|---|
| EP | 1002475 | | 5/2000 |
| EP | 1787540 | A1 | 5/2007 |
| GB | 2340378 | | 2/2000 |
| WO | WO 91/03180 | | 3/1991 |
| WO | WO 91/05491 | | 5/1991 |
| WO | WO 91/11924 | | 8/1991 |
| WO | WO 91/19429 | | 12/1991 |
| WO | WO 92/07483 | | 5/1992 |
| WO | WO 94/03080 | | 2/1994 |
| WO | 9703582 | A1 | 2/1997 |

* cited by examiner

ARTICLE OF FOOTWEAR HAVING A FLUID-FILLED CHAMBER WITH FLEXION ZONES

CROSS-REFERENCE TO RELATED APPLICATION

This U.S. Patent application is a continuation-in-part application of and claims priority to U.S. patent application Ser. No. 11/338,601, which was filed in the U.S. Patent and Trademark Office on Jan. 24, 2006 and entitled An Article Of Footwear Having A Fluid-Filled Chamber With Flexion Zones, such prior U.S. Patent Application being entirely incorporated herein by reference.

BACKGROUND

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground to attenuate ground reaction forces. The sole structure may also provide traction and control foot motions, such as over pronation. Accordingly, the upper and the sole structure operate cooperatively to provide a comfortable structure that is suited for a wide variety of ambulatory activities, such as walking and running.

The sole structure of athletic footwear generally exhibits a layered configuration that includes a comfort-enhancing insole, a resilient midsole formed from a polymer foam, and a ground-contacting outsole that provides both abrasion-resistance and traction. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. That is, the polymer foam includes a plurality of bubbles that enclose the gas. Following repeated compressions, the cell structure may deteriorate, thereby resulting in decreased compressibility of the foam. Accordingly, the force attenuation characteristics of the midsole may decrease over the lifespan of the footwear.

One manner of reducing the weight of a polymer foam midsole and decreasing the effects of deterioration following repeated compressions is disclosed in U.S. Pat. No. 4,183,156 to Rudy, hereby incorporated by reference, in which cushioning is provided by a fluid-filled chamber formed of an elastomeric materials. The chamber includes a plurality of tubular chambers that extend longitudinally along a length of the sole structure. The chambers are in fluid communication with each other and jointly extend across the width of the footwear. The chamber may be encapsulated in a polymer foam material, as disclosed in U.S. Pat. No. 4,219,945 to Rudy, hereby incorporated by reference. The combination of the chamber and the encapsulating polymer foam material functions as a midsole. Accordingly, the upper is attached to the upper surface of the polymer foam material and an outsole or tread member is affixed to the lower surface.

Chambers of the type discussed above are generally formed of an elastomeric material and are structured to have upper and lower portions that enclose one or more chambers therebetween. The chambers are pressurized above ambient pressure by inserting a nozzle or needle connected to a fluid pressure source into a fill inlet formed in the chamber. Following pressurization of the chambers, the fill inlet is sealed and the nozzle is removed.

Fluid-filled chambers suitable for footwear applications may be manufactured by a two-film technique, in which two separate sheets of elastomeric film are formed to exhibit the overall peripheral shape of the chamber. The sheets are then bonded together along their respective peripheries to form a sealed structure, and the sheets are also bonded together at predetermined interior areas to give the chamber a desired configuration. That is, the interior bonds provide the chamber with chambers having a predetermined shape and size. Such chambers have also been manufactured by a blow-molding technique, wherein a molten or otherwise softened elastomeric material in the shape of a tube is placed in a mold having the desired overall shape and configuration of the chamber. The mold has an opening at one location through which pressurized air is provided. The pressurized air induces the liquefied elastomeric material to conform to the shape of the inner surfaces of the mold. The elastomeric material then cools, thereby forming a chamber with the desired shape and configuration.

SUMMARY

One aspect of the invention is an article of footwear having an upper and a sole structure secured to the upper. The sole structure includes a midsole element and a fluid-filled chamber. The midsole element defines a first midsole portion and a second midsole portion separated by a midsole flexion zone, and the first midsole portion is rotatable with respect to the second midsole portion at the midsole flexion zone. The chamber has a first chamber portion and a second chamber portion separated by a chamber flexion zone, and the first chamber portion is rotatable with respect to the second chamber portion at the chamber flexion zone. The first chamber portion is coupled to the first midsole portion, the second chamber portion is coupled to the second midsole portion, and the chamber flexion zone is aligned with the midsole flexion zone.

Another aspect of the invention is an article of footwear having an upper and a sole structure secured to the upper. The sole structure includes a chamber having an outer barrier and a tensile member. The outer barrier has a first surface and an opposite second surface bonded together around a periphery of the chamber to define a peripheral bond and seal a fluid within the chamber. The tensile member is located within the outer barrier and is bonded to the first surface and the second surface to restrain outward movement of the first surface and the second surface due to a pressure of the fluid. The tensile member has a first portion and a second portion separated by a flexion zone, and at least a part of the tensile member being absent in the flexion portion. The first surface and the second surface are at least partially bonded together in the flexion zone and between the first portion and the second portion of the tensile member.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose an article of footwear 10 in accordance with aspects of the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures.

Footwear 10 is depicted in FIGS. 1-5 and includes an upper 20 and a sole structure 30. Upper 20 is formed from various material elements that are stitched or adhesively-bonded together to form an interior void that comfortably receives a foot and secures the position of the foot relative to sole structure 30. Sole structure 30 is secured to a lower portion of upper 20 and provides a durable, wear-resistant component for attenuating ground reaction forces and absorbing energy (i.e., providing cushioning) as footwear 10 impacts the ground.

Figure 1:
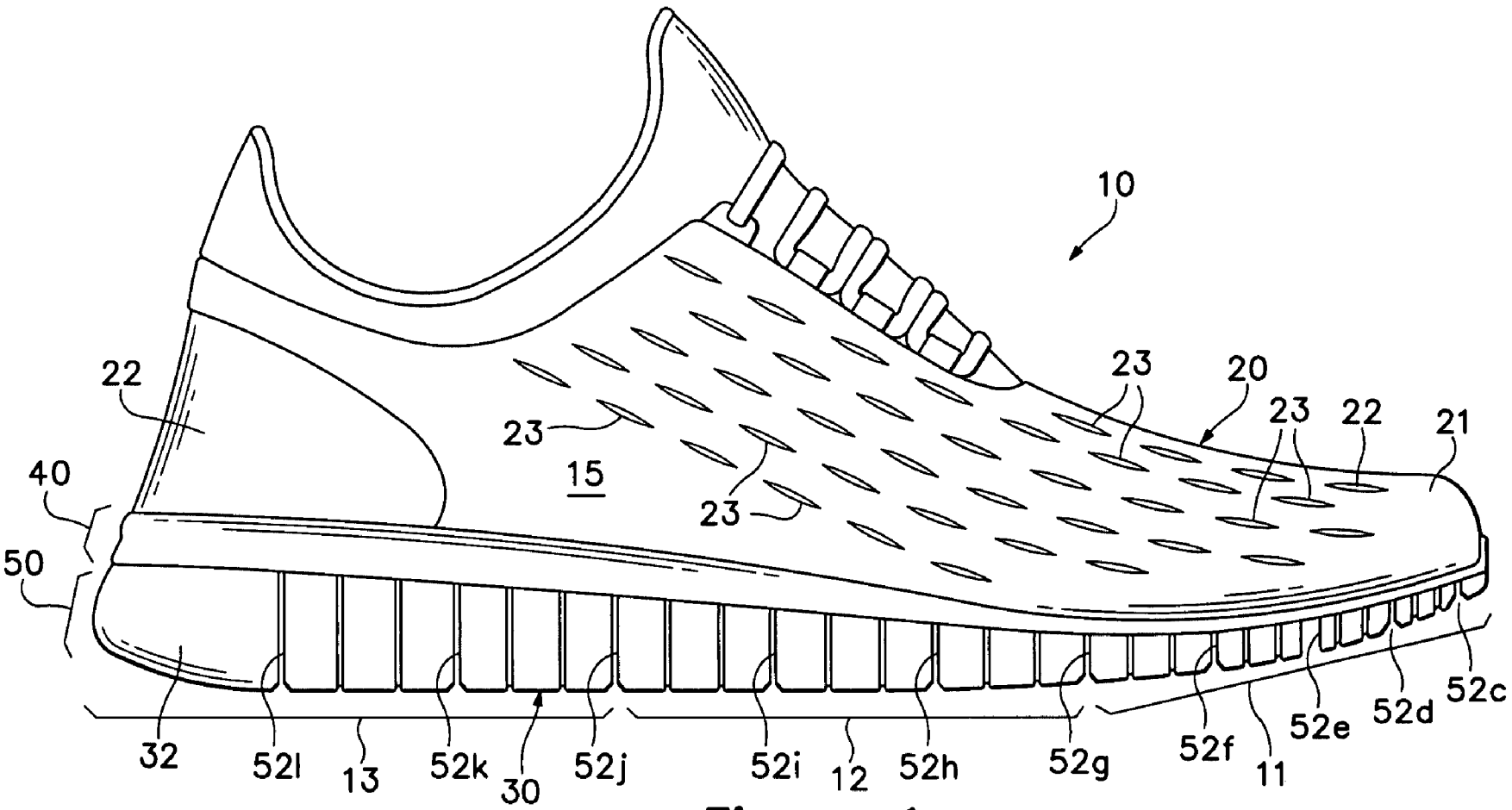
FIG. 1 is a lateral elevational view of an article of footwear having a first sole structure in accordance with aspects of the invention.
Figure 2:
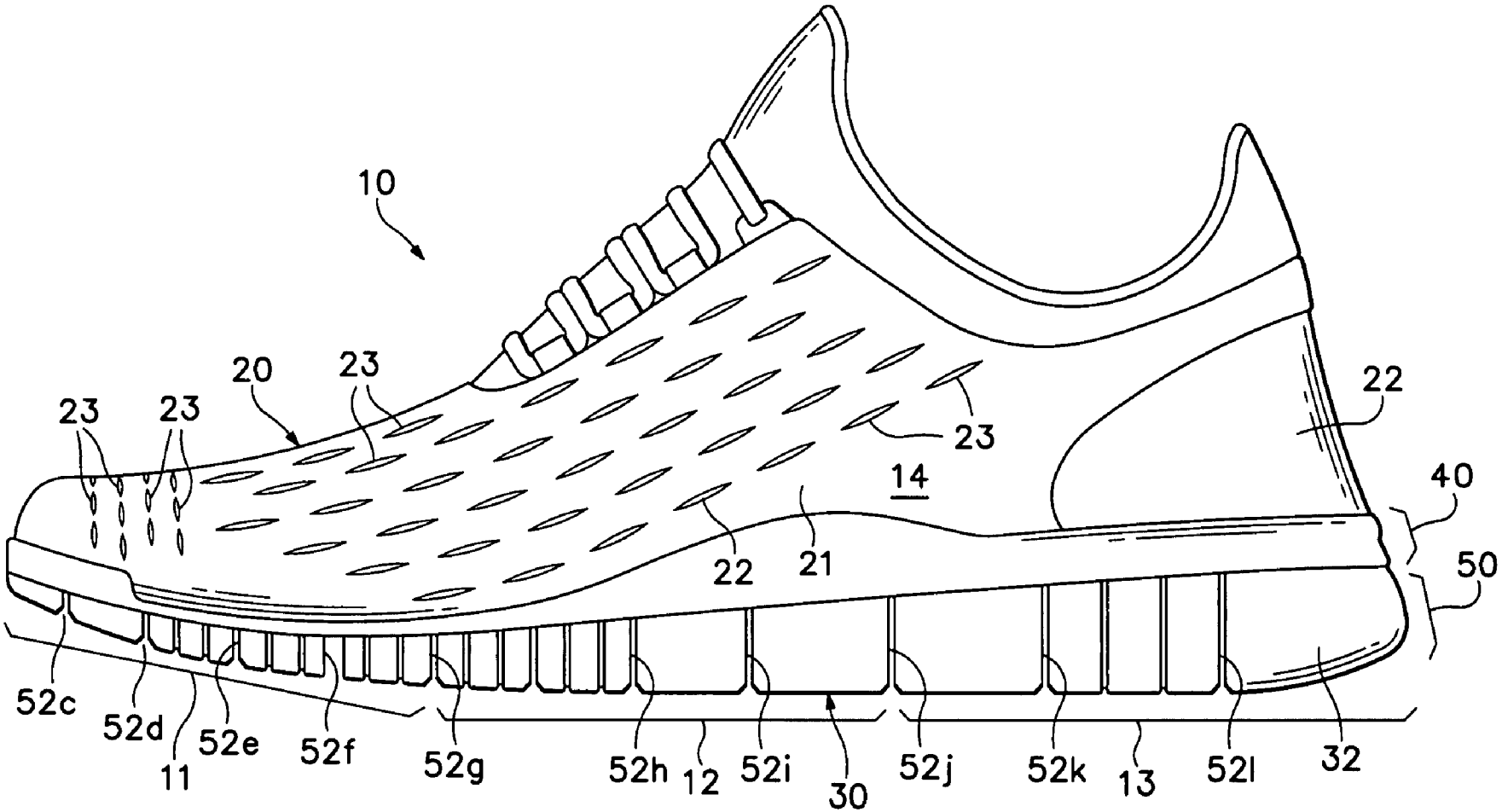
FIG. 2 is a medial elevational view of the article of footwear.
Figure 3:
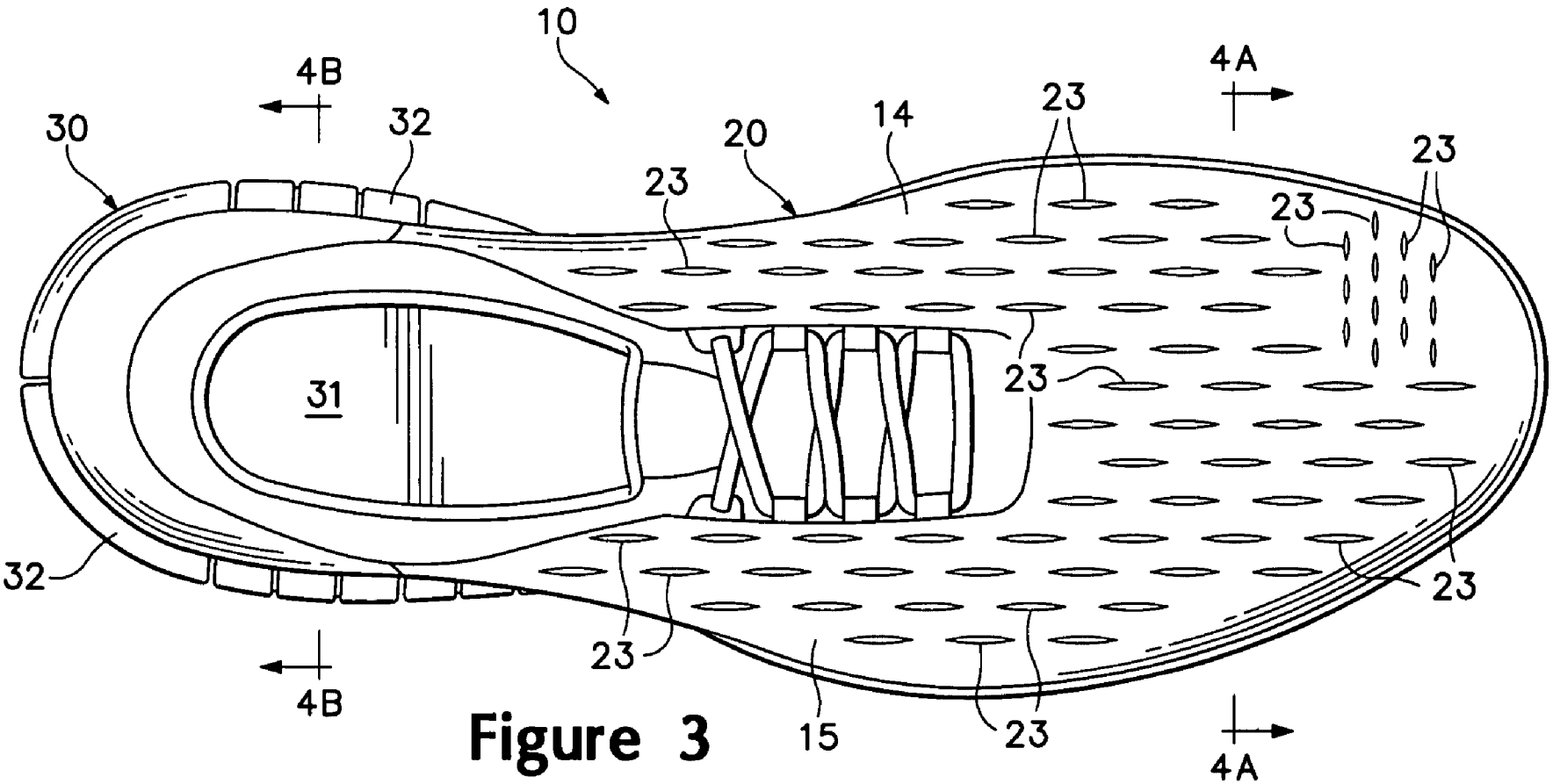
FIG. 3 is a top plan view of the article of footwear.

For purposes of reference, footwear 10 may be divided into three general regions: a forefoot region 11, a midfoot region 12, and a heel region 13, as defined in FIGS. 1 and 2. Footwear 10 also includes a medial side 14 and an opposite lateral side 15. Regions 11-13 and sides 14-15 are not intended to demarcate precise areas of footwear 10. Rather, regions 11-13 and sides 14-15 are intended to represent general areas of footwear 10 that provide a frame of reference during the following discussion. Although regions 11-13 and sides 14-15 apply generally to footwear 10, references to regions 11-13 and sides 14-15 may also apply specifically to upper 20, sole structure 30, or an individual component or portion within either of upper 20 or sole structure 30.

Figure 4A:
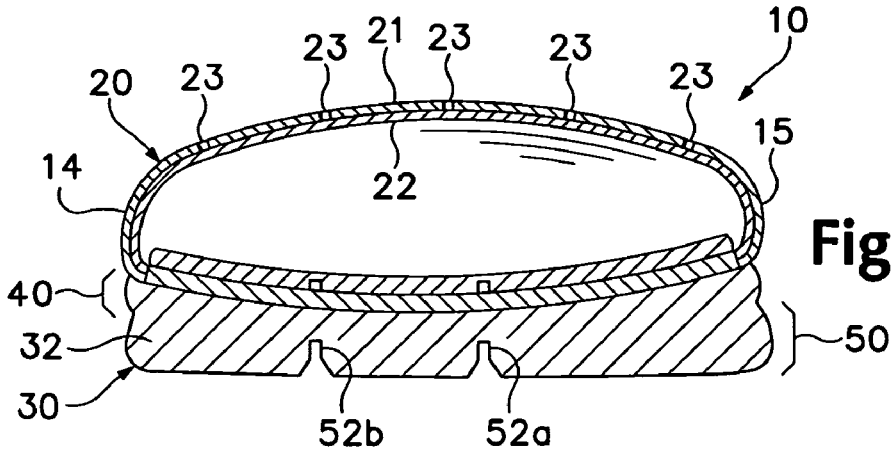
FIGS. 4A and 4B are cross-sectional views of the article of footwear, as defined by section lines 4A and 4B in FIG. 3.
Figure 4B:
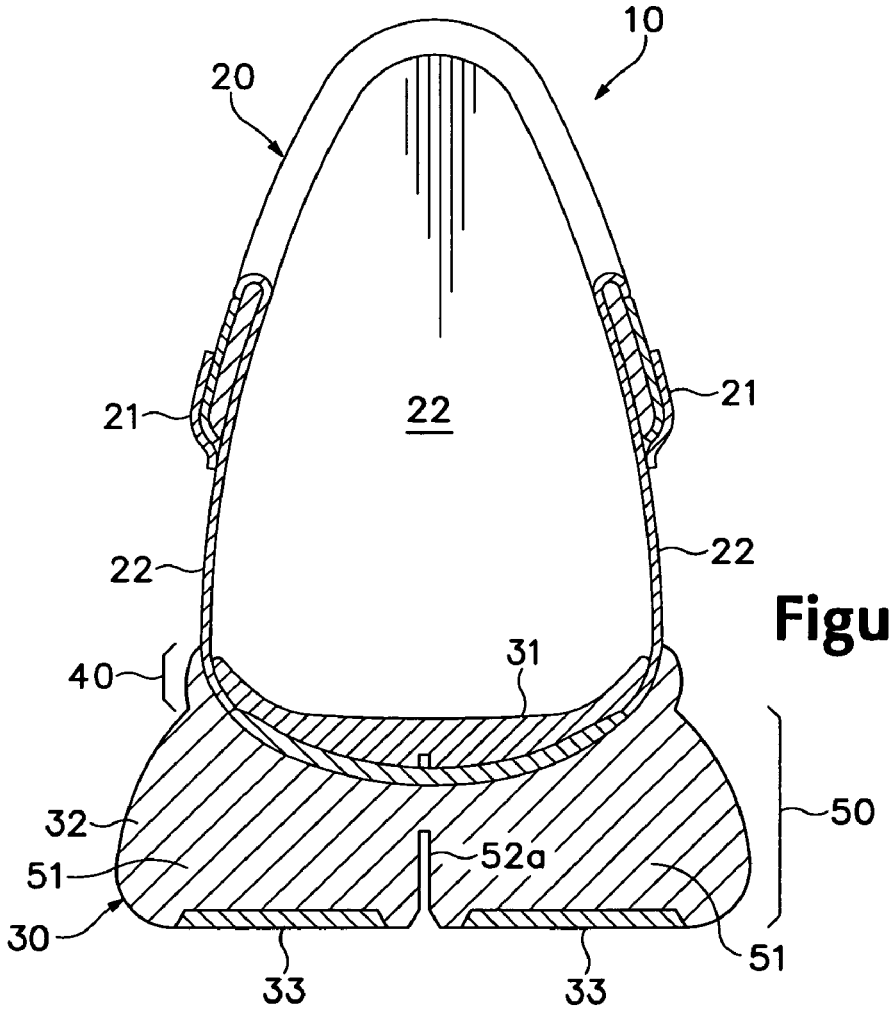

A variety of materials are suitable for upper 20, including the materials that are conventionally utilized in footwear uppers. Accordingly, upper 20 may be formed from combinations of leather, synthetic leather, natural or synthetic textiles, polymer sheets, polymer foams, mesh textiles, felts, non-woven polymers, or rubber materials, for example. The exposed portions of upper 20 are formed from two coextensive layers of material that are stitched or adhesively bonded together. As depicted in FIGS. 1, 2, and 4A, for example, the layers include an exterior layer 21 and an adjacent interior layer 22. Exterior layer 21 is positioned on an exterior of upper 20, and interior layer 22 is positioned on an interior of upper 20 so as to form a surface of the void within upper 20.

Exterior layer 21 includes a plurality of incisions 23 that expose underlying portions of interior layer 22. By exposing interior layer 22, the stretch properties of upper 20 are selectively modified. In areas where no incisions 23 are present, each of layers 21 and 22 contribute to the stretch-resistance of upper 20. In areas where incisions 23 are present, however, incisions 23 permit exterior layer 21 to stretch to a greater degree. Accordingly, incisions 23 are formed in upper 20 to selectively vary the degree of stretch in specific portions of upper 20. In addition, incisions 23 may be utilized to vary the air-permeability, flexibility, and overall aesthetics (e.g., color) of upper 20.

Sole structure 30 includes an insole 31, a midsole 32, and an outsole 33. Insole 31 is positioned within upper 20 and is positioned to contact the plantar (lower) surface of the foot and enhance the comfort of footwear 10. Midsole 32 is secured to a lower portion of upper 20 and is positioned to extend under the foot during use. Among other purposes, midsole 32 attenuates ground reaction forces when walking or running, for example Suitable materials for midsole 32 are any of the conventional polymer foams that are utilized in footwear midsoles, including ethylvinylacetate and polyurethane foam. Midsole 32 may also be formed from a relatively lightweight polyurethane foam having a specific gravity of approximately 0.22, as manufactured by Bayer AG under the BAYFLEX trademark. Outsole 33 is secured to a lower surface of midsole 32 to provide wear-resistance, and outsole 33 may be recessed within midsole 32. Although outsole 33 may extend throughout the lower surface of midsole 32, outsole 33 is located within heel portion 13 in the particular embodiment depicted in the figures. Suitable materials for outsole 33 include any of the conventional rubber materials that are utilized in footwear outsoles, such as carbon black rubber compound.

A conventional footwear midsole is a unitary, polymer foam structure that extends throughout the length of the foot and may have a stiffness or inflexibility that inhibits the natural motion of the foot. In contrast with the conventional footwear midsole, midsole 32 has an articulated structure that imparts relatively high flexibility and articulation. The flexible structure of midsole 32 (in combination with the structure of upper 20) is configured to complement the natural motion of the foot during running or other activities, and may impart a feeling or sensation of barefoot running. In contrast with barefoot running, however, midsole 32 attenuates ground reaction forces to decrease the overall stress upon the foot.

Midsole 32 includes a connecting portion 40 and a siped portion 50. Connecting portion 40 forms an upper surface 41 and an opposite lower surface 42. Upper surface 41 is positioned adjacent to upper 20 and may be secured directly to upper 20, thereby providing support for the foot. Upper surface 41 may, therefore, be contoured to conform to the natural, anatomical shape of the foot. Accordingly, the area of upper surface 41 that is positioned in heel region 13 may have a greater elevation than the area of upper surface 41 in forefoot region 11. In addition, upper surface 41 may form an arch support area in midfoot region 12, and peripheral areas of upper surface 41 may be generally raised to provide a depression for receiving and seating the foot. In further embodiments, upper surface 41 may have a non-contoured configuration.

Figure 6:
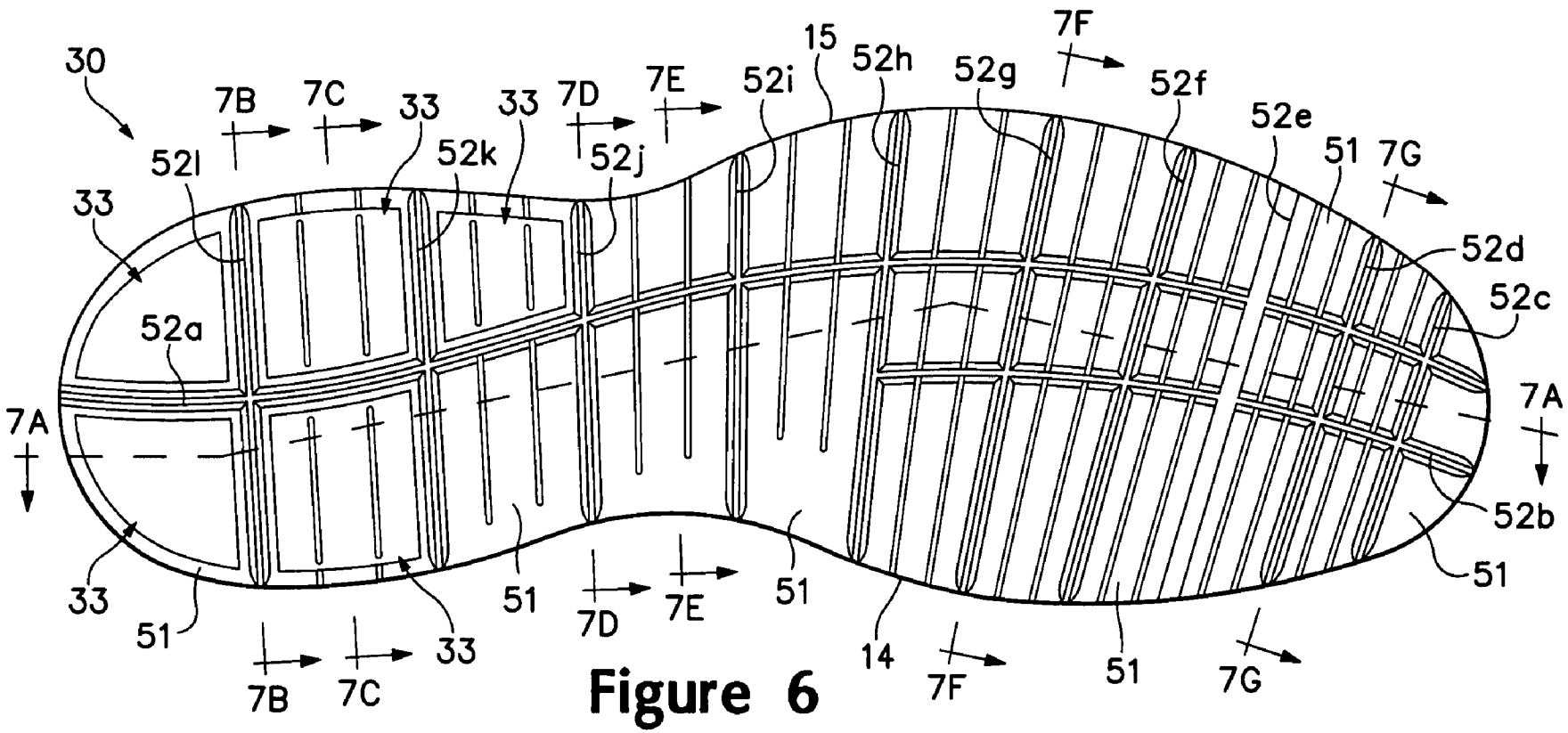
FIG. 6 is a bottom plan view of the first sole structure.
Figure 7A:
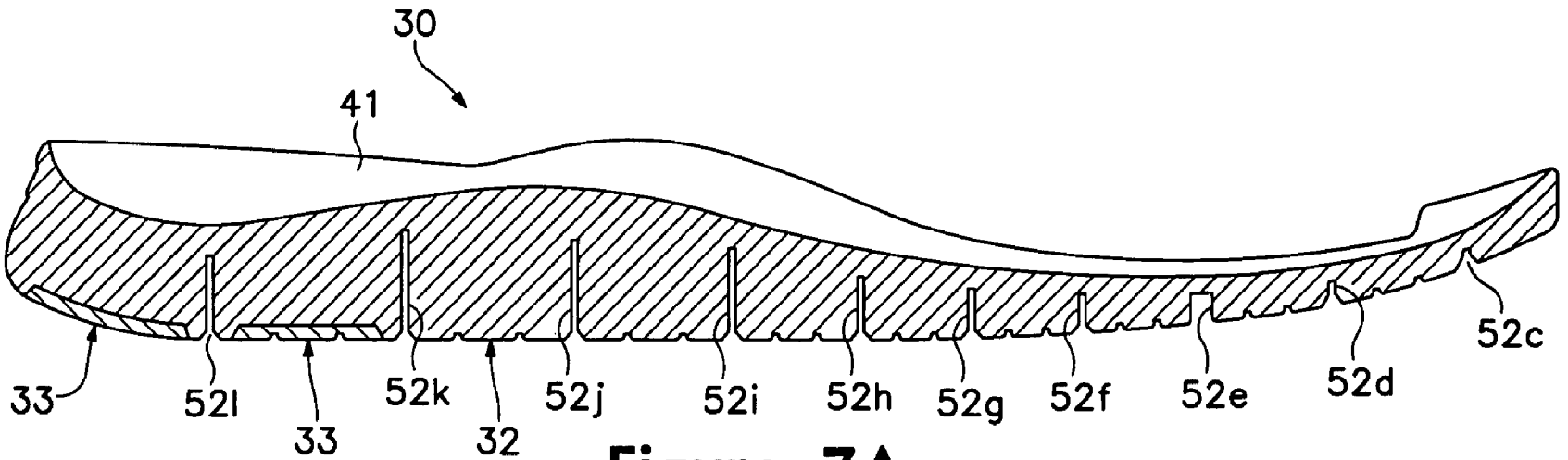
FIGS. 7A-7G are cross-sectional views of the first sole structure, as defined by section lines 7A-7G in FIG. 6.
Figure 7B:
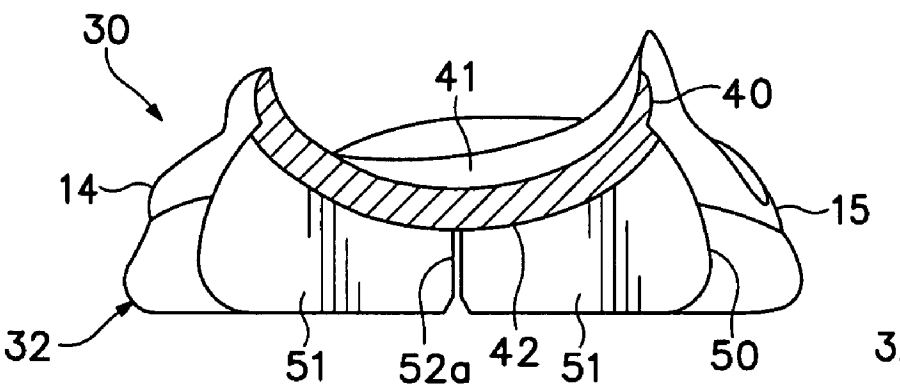
Figure 7C:
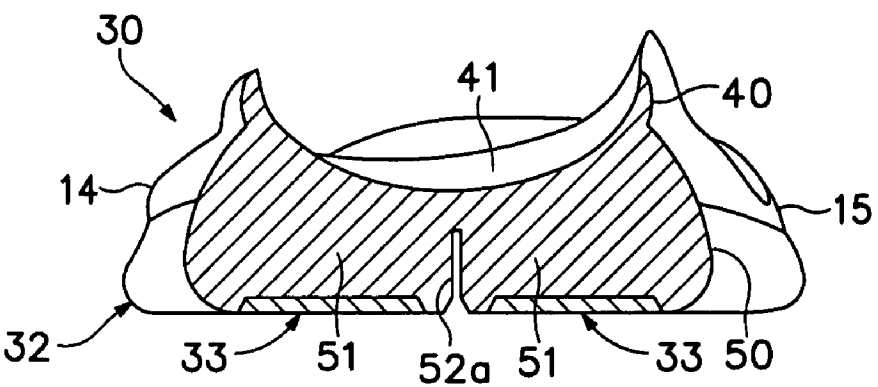
Figure 7D:
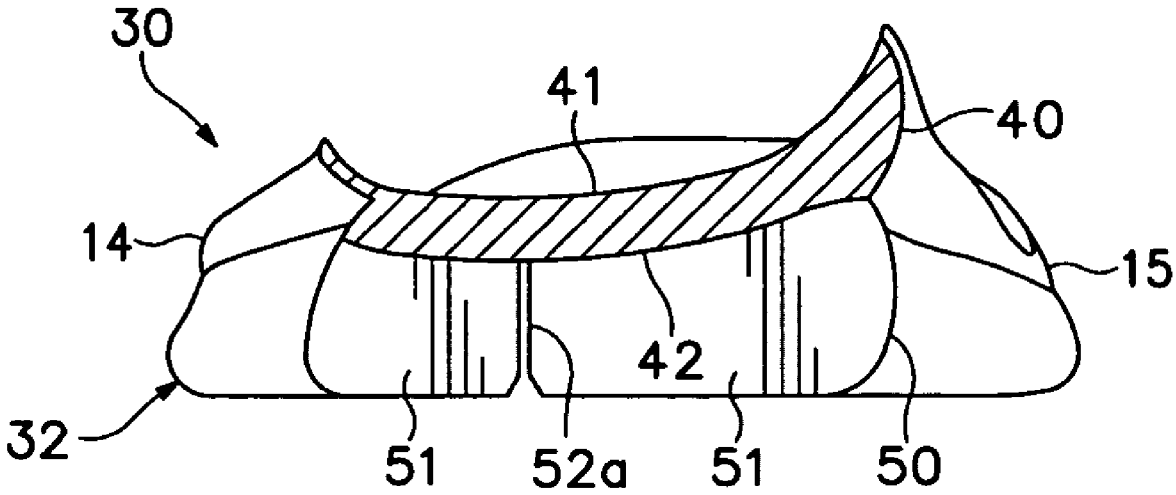
Figure 7E:
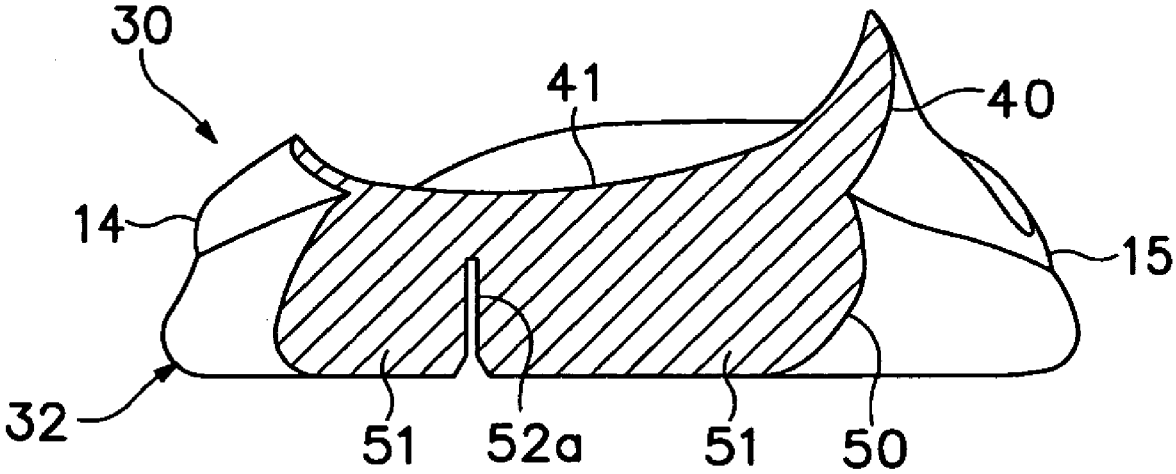
Figure 7F:
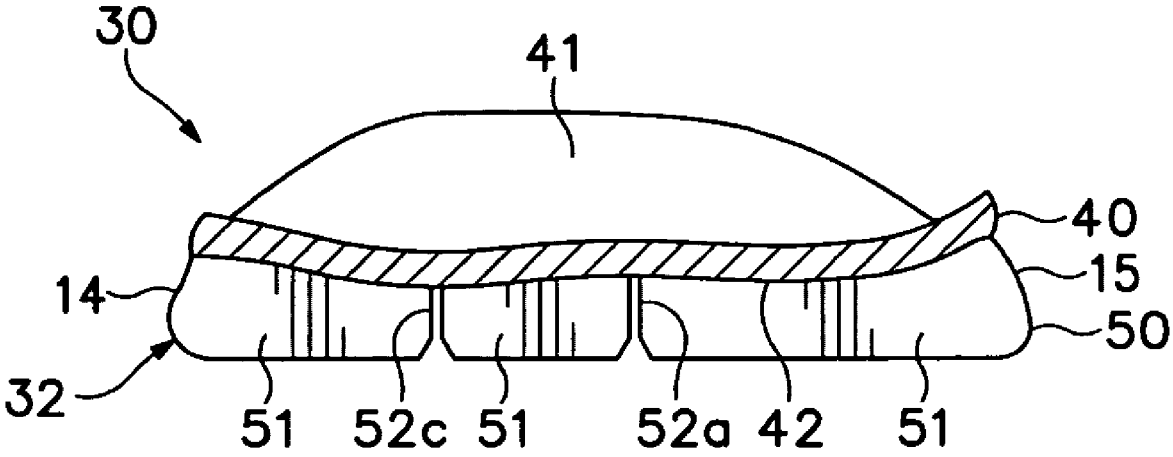
Figure 7G:
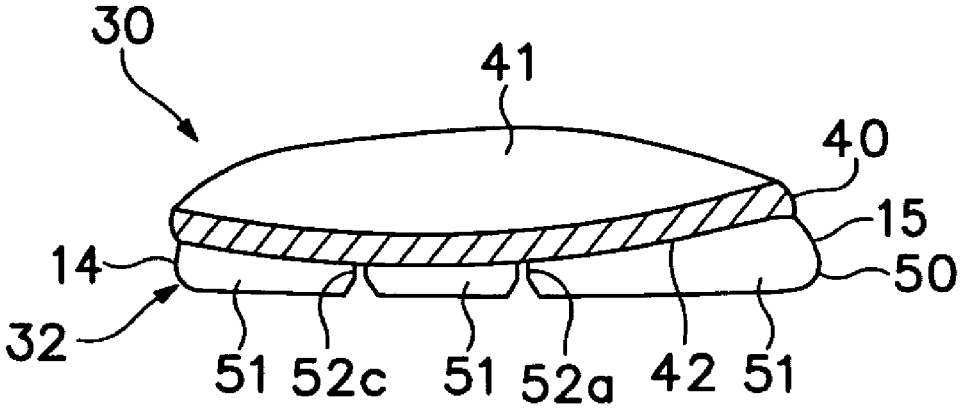

Siped portion 50 forms a plurality of individual, separate sole elements 51 that are separated by a plurality of sipes 52*a*-52*l*. Sole elements 51 are discrete portions of midsole 30 that extend downward from connecting portion 40. In addition, sole elements 51 are secured to connecting portion 40 and may be formed of unitary (i.e., one-piece) construction with connecting portion 40. The shape of each sole element 51 is determined by the positions of the various sipes 52*a*-52*l*. As depicted in FIG. 6, sipes 52*a* and 52*b* extend in a longitudinal direction along sole structure 30, and sipes 52*c*-52*l* extend in a generally lateral direction. This positioning of sipes 52*a*-52*l* forms a majority of sole elements 51 to exhibit a generally square, rectangular, or trapezoidal shape. The rearmost sole elements 51 have a quarter-circular shape due to the curvature of sole structure 30 in heel region 13.

The shape of each sole element 51, as discussed above, is determined by the positions of the various sipes 52*a*-52*l*, which are incisions or spaces that extend upward into midsole 32 and extend between sole elements 51. In general, sipes 52*a*-52*l* may extend at least one-half of a distance between the lower surface of sole elements 51 and upper surface 41. That is, sipes 52*a*-52*l* may be indentations or incisions in midsole 32 that extend through at least one-half of a thickness of midsole 32. In some embodiments, however, sipes 52*a*-52*l* may extend through less than one-half of the thickness of midsole 32.

Sipes 52*a*-52*l* increase the flexibility of sole structure 30 by forming an articulated configuration in midsole 32, as depicted in FIGS. 7A-7G. Whereas the conventional footwear midsole is a unitary element of polymer foam, sipes 52*a*-52*l* form flexion lines in sole structure 30 and, therefore, have an effect upon the directions of flex in midsole 32. The manner in which sole structure 30 may flex or articulate as a result of sipes 52*a*-52*l* is graphically depicted in FIG. 5.

Lateral flexibility of sole structure 30 (i.e., flexibility in a direction that extends between a lateral side and a medial side) is provided by sipes 52*a* and 52*b*. Sipe 52*a* extends longitudinally through all three of regions 11-13. Although sipe 52*a* may have a straight or linear configuration, sipe 52*a* is depicted as having a generally curved or s-shaped configuration. In forefoot region 11 and midfoot region 12, sipe 52*a* is spaced inward from the lateral side of sole structure 30, and sipe 52*a* is centrally-located in heel region 13. Sipe 52*b*, which is only located in forefoot region 11 and a portion of midfoot region 12, is centrally-located and extends in a direction that is generally parallel to sipe 52*a*. In general, the depth of sipes 52*a* and 52*b* increase as sipes 52*a* and 52*b* extend from forefoot region 11 to heel region 13.

Longitudinal flexibility of sole structure 30 (i.e., flexibility in a direction that extends between regions 11 and 13) is provided by sipes 52*c*-52*l*. Sipes 52*c*-52*f* are positioned in forefoot region 11, sipe 52*g* generally extends along the interface between forefoot region 11 and midfoot region 12, sipes 52*h* and 52*i* are positioned in midfoot region 12, sipe 52*j* generally extends along the interface between midfoot region 12 and heel region 13, and sipes 52*k* and 521 are positioned in heel region 13. Referring to FIG. 6, sipes 52*i*-52*l* are generally parallel and extend in a medial-lateral direction. Although sipes 52*c*-52*h* also have a generally parallel configuration and extend in the medial-lateral direction, sipes 52*c*-52*h* are somewhat angled with respect to sipes 52*i*-52*l*.

The positions and orientations of sipes 52*a*-52*l* are selected to complement the natural motion of the foot during the running cycle. In general, the motion of the foot during running proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last. Sipes 52*c*-52*l* ensure that the foot remains in a neutral foot-strike position and complement the neutral forward roll of the foot as it is in contact with the ground. Sipes 52*a* and 52*b* provide lateral flexibility in order to permit the foot to pronate naturally during the running cycle. Similarly, the angled configuration of sipes 52*c*-52*h*, as discussed above, provides additional flexibility that further enhances the natural, motion of the foot.

Figure 5:
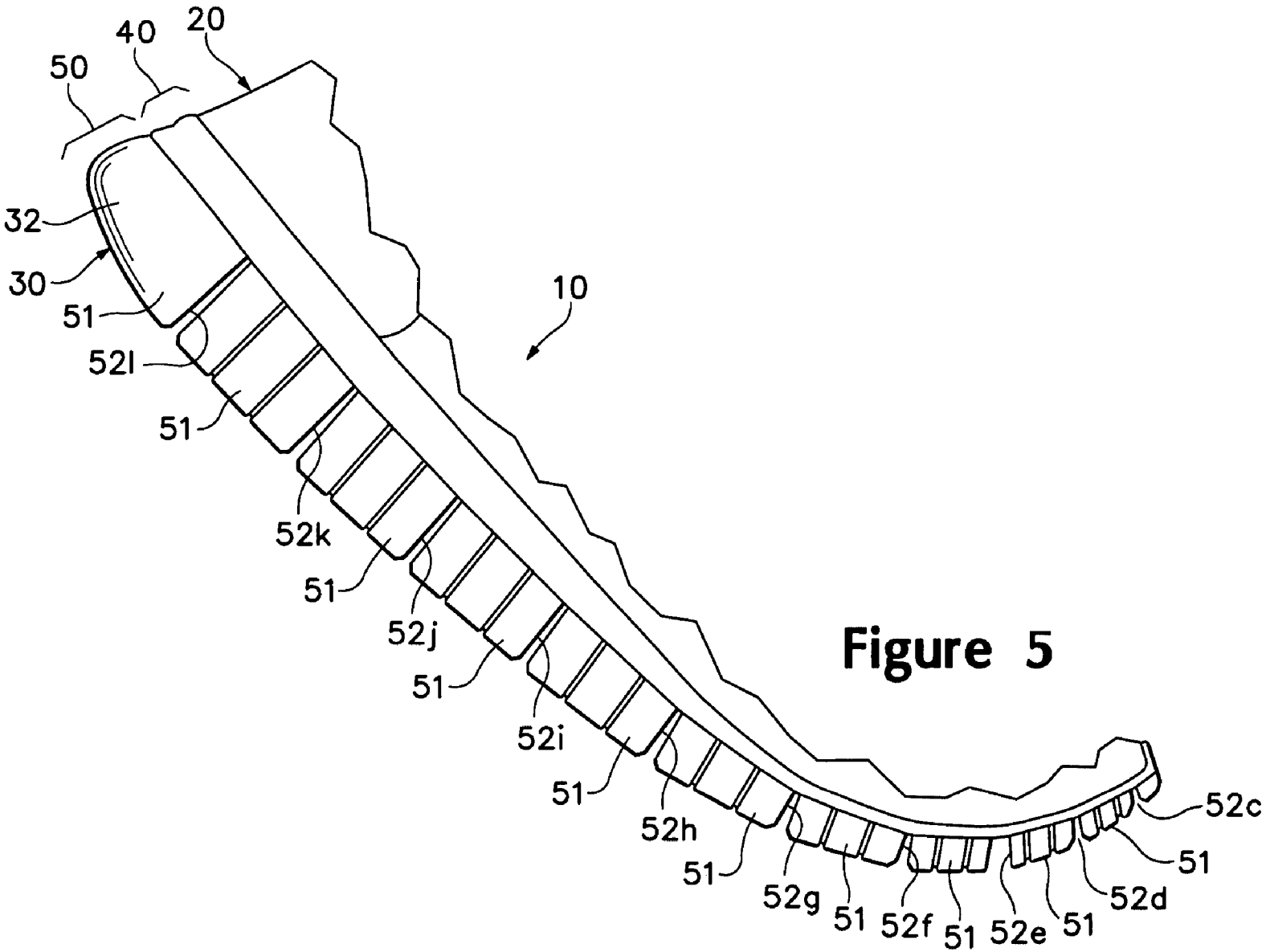
FIG. 5 is a partial lateral elevational view of the article of footwear in a flexed configuration.

Sipe 52*e* has a width that is greater than the other sipes 52*a*-52*d* and 52*f*-53*l* in order to permit reverse flex in forefoot region 11. In general, sipes 52*a*-52*l* permit upward flexing of sole structure 30, as depicted in FIG. 5. In order to provide further traction at the end of the running cycle (i.e., prior to when the toes leave the ground), an individual may plantarflex the toes or otherwise press the toes into the ground. The wider aspect to sipe 52*e* facilitates the plantar flexion, thereby encouraging the natural motion of the foot during running. That is, sipe 52*e* forms a reverse flex groove in midsole 32. In some embodiments, two or more of sipes 52*c*-52*g* may exhibit a wider aspect to facilitate reverse flex.

Outsole 33 includes a plurality of outsole elements that are secured to a lower surface of selected sole elements 51, and an indentation is formed in the lower surface of the selected sole elements 51 to receive the outsole elements. As depicted in the figures, outsole 33 is limited to heel region 13. In some embodiments, however, each sole element 51 may be associated with an outsole element, or outsole 33 may extend throughout the lower surface of midsole 32.

A plurality of manufacturing methods are suitable for forming midsole 32. For example, midsole 32 may be formed as a unitary element, with sipes 52*a*-52*l* being subsequently formed through an incision process. Midsole 32 may also be molded such that sipes 52*a*-52*l* are formed during the molding process. Suitable molding methods for midsole 32 include injection molding, pouring, or compression molding, for example. In each of the molding methods, a blown polymer resin is placed within a mold having the general shape and configuration of midsole 32. The mold includes thin blades that correspond with the positions of sipes 52*a*-52*l*. The polymer resin is placed within the mold and around each of the blades. Upon setting, midsole 32 is removed from the mold, with sipes 52*a*-52*l* being formed during the molding process. The width of sipes 52*a*-52*l* may be controlled through modifications to the blade thicknesses within the mold. Accordingly, the reverse flex properties of sipe 52*e*, for example, may be adjusted through the thickness of the blade that forms sipe 52*e*, and the degree to which the other sipes 52*a*-52*d* and 52*f*-52*l* flex in the reverse direction may be controlled through the thickness of corresponding blades. A suitable width range for the blades that form sipes 52*a*-52*d* and 52*f*-52*l* is 0.2-0.3 millimeters, which provides a relatively small degree of reverse flex. Similarly, a suitable width range for the portion of the mold that forms sipe 52*e* is 3-5 millimeters, for example, which provides a greater degree of reverse flex.

Upper 20 and sole structure 30 have a structure that cooperatively flex, stretch, or otherwise move to provide an individual with a sensation of natural, barefoot running. That is, upper 20 and sole structure 30 are configured to complement the natural motion of the foot during running or other activities. As discussed above, exterior layer 14 includes a plurality of incisions 23 that enhance the stretch properties of upper 20 in specific areas and in specific directions. The positions, orientations, and depths of sipes 52*a*-52*l* are selected to provide specific degrees of flexibility in selected areas and directions. That is, sipes 52*a*-52*l* may be utilized to provide the individual with a sensation of natural, barefoot running. In contrast with barefoot running, however, sole structure 30 attenuates ground reaction forces to decrease the overall stress upon the foot.

The conventional sole structure, as discussed above, may have a relatively stiff or inflexible construction that inhibits the natural motion of the foot. For example, the foot may attempt to flex during the stage of the running cycle when the heel leaves the ground. The combination of the inflexible midsole construction and a conventional heel counter operates to resist flex in the foot. In contrast, footwear 10 flexes with the foot, and may have a configuration that does not incorporate a conventional heel counter.

An alternate configuration for sole structure 30 is depicted in FIGS. 8-11D. In contrast with the configuration discussed above, FIGS. 8-11D depict midsole 32 as including a fluid-filled chamber 60 that enhances the ground reaction force attenuation properties of sole structure 30. The polymer foam material of midsole 32 is depicted as defining an indentation in upper surface 41 that receives chamber 60. Alternately, chamber 60 may replace insole 31, chamber 60 may rest upon upper surface 41, or the polymer foam material may encapsulate chamber 60. Accordingly, a variety of techniques may be utilized to incorporate chamber 60 into sole structure 30.

The primary elements of chamber 60 are an outer barrier 70 and a tensile member 80. Barrier 70 may be formed of a polymer material and includes a first barrier layer 71 and a second barrier layer 72 that are substantially impermeable to a pressurized fluid contained by chamber 60. First barrier layer 71 and second barrier layer 72 are bonded together around their respective peripheries to form a peripheral bond 73 and cooperatively form a sealed element, in which tensile member 80 is positioned. First barrier layer 71 forms an upper surface of chamber 60, second barrier layer 72 forms a lower surface of chamber 60, and each of barrier layers 71 and 72 form a portion of a sidewall surface of chamber 60. This configuration positions peripheral bond 73 at a position that is between the upper surface and the lower surface of chamber 60. Peripheral bond 73 may, therefore, extend through the sidewall surface such that both first barrier layer 71 and second barrier layer 72 form a portion of the sidewall surface. Alternately, peripheral bond 73 may be positioned adjacent to one of the upper surface or the lower surface to promote visibility through the sidewall surface. Accordingly, the specific configuration of barrier 70 may vary significantly. In addition to peripheral bond 73, barrier 70 defines a plurality of flexion bonds 74 located inward of peripheral bond 73.

Tensile member 80 may be formed as a plurality of separate elements of a textile structure that includes a first wall 81, a second wall 82, and a plurality of connecting members 83 anchored to each of first wall 81 and second wall 82. First wall 81 is spaced away from second wall 82, and connecting members 83 extend between first wall 81 and second wall 82 to retain a substantially constant spacing between walls 81 and 82. As discussed in greater detail below, first wall 81 is bonded to first barrier layer 71, and second wall 82 is bonded to second barrier layer 72. In this configuration, the pressurized fluid within chamber 60 places an outward force upon barrier layers 71 and 72 and tends to move barrier layers 71 and 72 apart. The outward force supplied by the pressurized fluid, however, extends connecting members 83 and places connecting members 83 in tension, which restrains further outward movement of barrier layers 71 and 72. Accordingly, tensile member 80 is bonded to the interior surfaces of chamber 60 and limits the degree to which barrier layers 71 and 72 may move apart upon pressurization of chamber 60.

A variety of techniques may be utilized to bond tensile member 80 to each of first barrier layer 71 and second barrier layer 72. For example, a layer of thermally activated fusing agent may be applied to first wall 71 and second wall 72. The fusing agent may be a sheet of thermoplastic material, such as thermoplastic polyurethane, that is heated and pressed into contact with first wall 71 and second wall 72 prior to placing tensile member 80 between barrier layers 71 and 72. The various elements of chamber 60 are then heated and compressed such that the fusing agent bonds with barrier layers 71 and 72, thereby bonding tensile member 80 to barrier 70. Alternately, a plurality of fusing filaments may be integrated into first wall 81 and second wall 82. The fusing filaments are formed of a material that will fuse, bond, or otherwise become secured to barrier layers 71 and 72 when the various components of chamber 60 are heated and compressed together. Suitable materials for the fusing filaments include, therefore, thermoplastic polyurethane or any of the materials that are discussed below as being suitable for barrier layers 71 and 72. The fusing filaments may be woven or otherwise mechanically manipulated into walls 81 and 82 during the manufacturing process for tensile element 80, or the fusing filaments may be subsequently incorporated into walls 81 and 82.

Tensile member 80 includes a plurality of separate elements that correspond in location to sole elements 51 of midsole 32. More particularly, the separate elements of tensile member 80 are shaped to generally correspond with sole elements 51, and the separate elements are positioned above sole elements 51. Flexion bonds 74 extend between the separate elements of tensile member 80 and correspond in location to various sipes 52*a*-52*l*. An advantage of flexion bonds 74 is that chamber 60 tends to flex or otherwise bend along the various lines defined by flexion bonds 74. That is, flexion bonds 74 form an area of chamber 60 that is more flexible than other areas of chamber 60. In bending, therefore, the portions of chamber 60 that include the various separate elements of tensile member 80 will flex with respect to each other along the lines defined by flexion bonds 74. In some configurations of chamber 60, the separate elements of tensile member 80 may exhibit different thicknesses to vary the thickness of chamber 60 in different locations. For example, areas of chamber 60 corresponding with the arch of the foot may have greater thickness than other areas.

Sipes 52*a*-52*l* define various areas or zones of flexion in sole structure 30. As discussed above, the positions, orientations, and depths of sipes 52*a*-52*l* are selected to provide specific degrees of flexibility in selected areas and directions, and sipes 52*a*-52*l* may be utilized to provide the individual with a sensation of natural, barefoot running. Flexion bonds 74 promote this purpose by enhancing the flexibility of chamber 60 in areas corresponding with sipes 52*a*-52*l*. Furthermore, sipes 52*a* and 52*b* are substantially parallel to each other, and flexion bonds 74 that correspond with sipes 52*a* and 52*b* will also be substantially parallel to each other. Similarly, sipes 52*c*-52*l* are substantially parallel to each other, and flexion bonds 74 that correspond with sipes 52*c*-52*l* will also be substantially parallel to each other.

The portions of chamber 60 that include tensile member 80 are effectively formed from seven layers of material: first barrier layer 71, the fusing agent adjacent to first barrier layer 71, first wall 81, connecting members 83, second wall 82, the fusing agent adjacent to second barrier layer 72, and second barrier layer 72. In order for these portions to flex when chamber 60 is pressurized or otherwise inflated, each of the seven layers of material (with the potential exception of connecting members 83) must either stretch or compress in response to a bending force. In contrast, the portions of chamber 60 corresponding with flexion bonds 74 is effectively formed from two layers of material: first barrier layer 71 and second barrier layer 72. In order for this portion to flex, only barrier layers 71 and 72 must either stretch or compress in response to the bending force. Accordingly, the portion of chamber 60 corresponding with flexion bonds 74 will exhibit greater flexibility due to the decreased number of materials present at flexion bonds 74.

Flexion bonds 74 may include various gaps that permit the fluid in chamber 60 to circulate throughout chamber 60. That is, each of the areas of chamber 60 that include the separate elements of tensile member 80 may be in fluid communication. In this configuration, the pressure of the fluid will be substantially equal in each area of chamber 60. As an alternative, flexion bonds 74 may prevent fluid communication among various areas of chamber 60. For example, flexion bonds 74 may form various sub-chambers corresponding with each of the separate elements of tensile member 80, or flexion bonds 74 may separate areas of chamber 60 corresponding with regions 11-13. An advantage to preventing fluid communication among various areas of chamber 60 is that the areas may each have different initial pressures. For example, the portions of chamber 60 in forefoot region 11 and heel region 13 may have a higher fluid pressure than the portion in midfoot region 12.

The material forming barrier 70 may be a polymer material, such as a thermoplastic elastomer. More specifically, a suitable material for barrier 70 is a film formed of alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Another suitable material for barrier 70 is a flexible microlayer membrane that includes alternating layers of a gas barrier material and an elastomeric material, as disclosed in U.S. Pat. Nos. 6,082,025 and 6,127,026 to Bonk et al., both hereby incorporated by reference. Other suitable thermoplastic elastomer materials or films include polyurethane, polyester, polyester polyurethane, polyether polyurethane, such as cast or extruded ester-based polyurethane film. Additional suitable materials are disclosed in U.S. Pat. Nos. 4,183,156 and 4,219,945 to Rudy, hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference. The fluid contained by chamber 60 may be any of the gasses disclosed in U.S. Pat. No. 4,340,626 to Rudy, hereby incorporated by reference, such as hexafluoroethane and sulfur hexafluoride, for example. In addition, the fluid may include pressurized octafluorapropane, nitrogen, and air. The pressure of the fluid may range from a gauge pressure of zero to forty pounds per square inch, for example.

A variety of manufacturing methods may be employed for tensile member 80, including a double needle bar Raschel knitting process. Each of first wall 81, second wall 82, and connecting members 83 may be formed of air-bulked or otherwise texturized yarn, such as false twist texturized yarn having a combination of Nylon 6,6 and Nylon 6, for example. Although the thickness of tensile member 80, which is measured when connecting members 83 are in a tensile state between first wall 81 and second wall 82, may vary significantly within the scope of the present invention, a thickness that is suitable for footwear applications may range from 2 to 15 millimeters. As noted above, the separate elements of tensile member 80 may exhibit different thicknesses to vary the thickness of chamber 60 in different locations.

Connecting members 83 may have a denier per filament of approximately 1 to 20, with one suitable range being between 2 and 5. The individual tensile filaments that comprise connecting members 83 may exhibit a tensile strength of approximately 2 to 10 grams per denier and the number of tensile filaments per yarn may range from approximately 1 to 100, with one suitable range being between 40 and 60. In general, there are approximately 1 to 8 yarns per tuft or strand and tensile member 60 may be knitted with approximately 200 to 1000 tufts or strands per square inch of fabric, with one suitable range being between 400 and 500 strands per square inch. The bulk density of the fabric is, therefore, in the range of about 20,000 to 300,000 fibers per square inch-denier.

Connecting members 83 may be arranged in rows that are separated by gaps. The use of gaps provides tensile member 80 with increased compressibility in comparison to tensile members formed of double-walled fabrics that utilize continuous connecting yarns. The gaps may be formed during the double needle bar Raschel knitting process by omitting connecting yarns on certain predetermined needles in the warp direction. Knitting with three needles in and three needles out produces a suitable fabric with rows of connecting members 83 being separated by gaps. Other knitting patterns of needles in and needles out may also be used, such as two in and two out, four in and two out, two in and four out, or any combination thereof. Also, the gaps may be formed in both a longitudinal and transverse direction by omitting needles in the warp direction or selectively knitting or not knitting on consecutive courses.

A variety of manufacturing methods may be employed to produce chamber 60. For example, a two-film technique may be utilized where the various elements of tensile member 80 are arranged on and bonded to first barrier layer 71. Second barrier layer 72 is then bonded to opposite sides of the various elements of tensile member 80. Following bonding of tensile member 80 to barrier 70, each of peripheral bond 73 and flexion bonds 74 are formed. Chamber 60 may then be pressurized. As an alternative, a thermoforming process that is similar to a process disclosed in U.S. Pat. No. 6,837,951 to Rapaport may be utilized. As a further alternative, tensile member 80 is arranged on and bonded to first barrier layer 71 and second barrier layer 72, peripheral bond 73 is formed, chamber 60 is pressurized, and then each of and flexion bonds 74 are formed.

Figure 12:
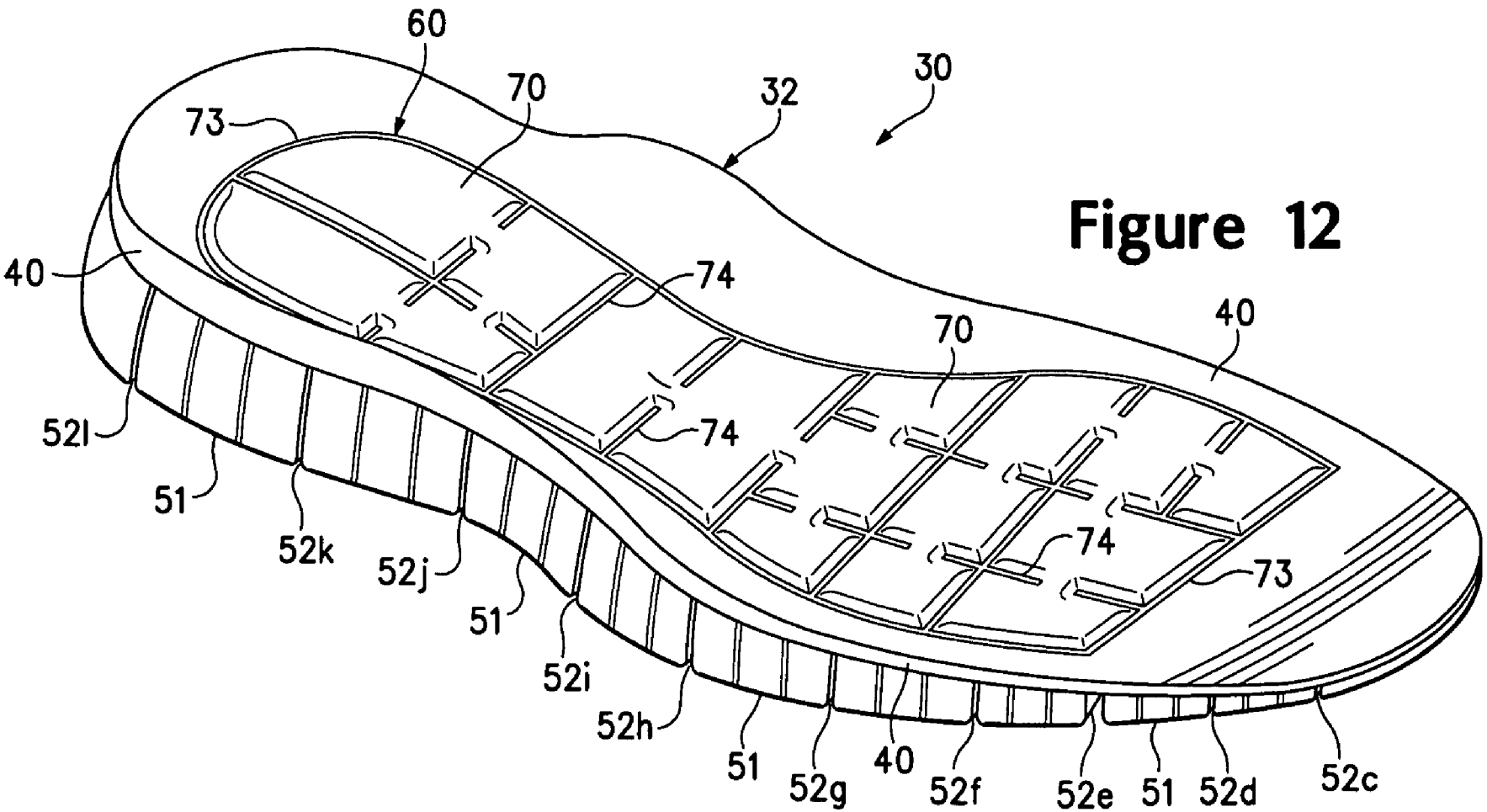
FIG. 12 is a perspective view of a third sole structure.
Figure 13:
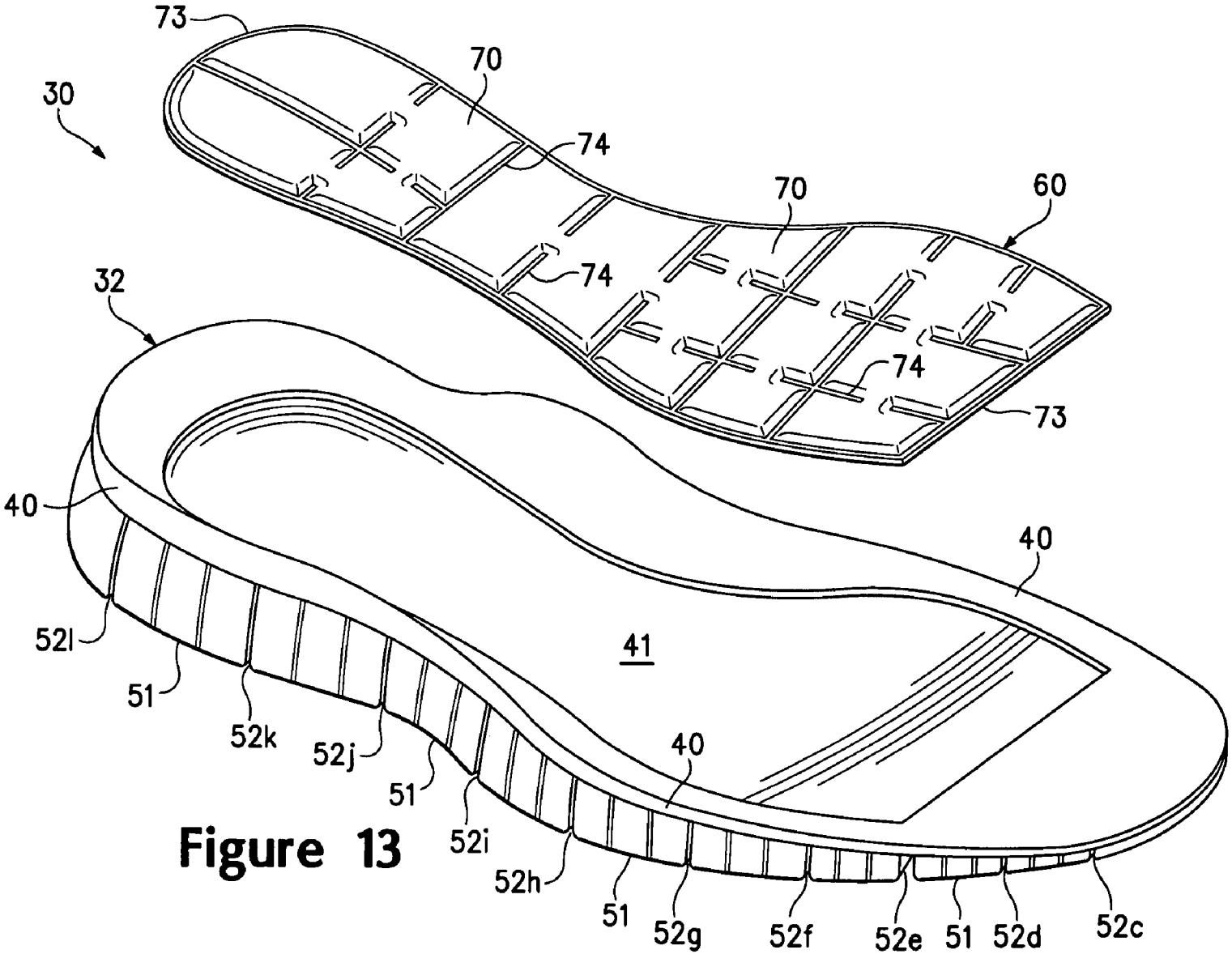
FIG. 13 is an exploded perspective view of the third sole structure.
Figure 14:
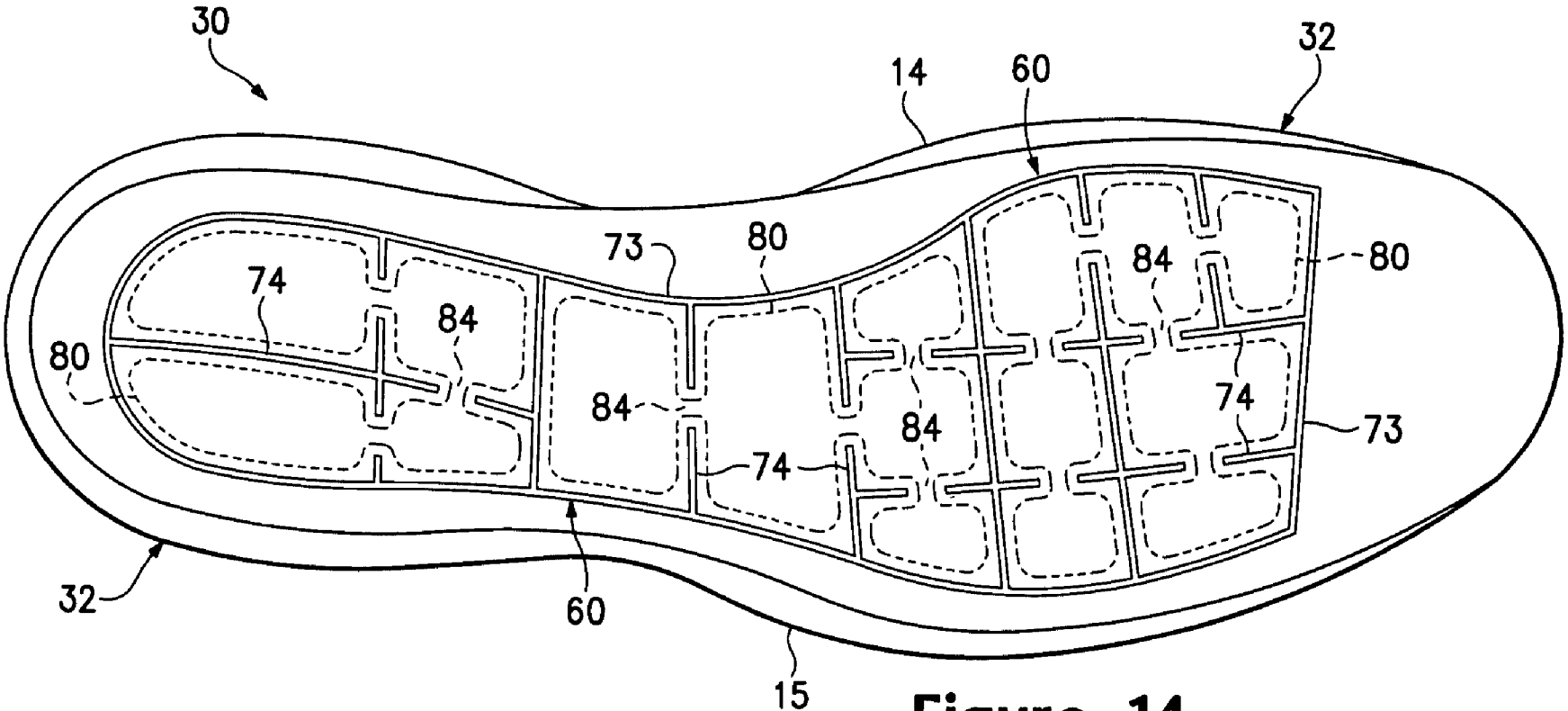
FIG. 14 is a top plan view of the third sole structure.

Another configuration for sole structure 30 is depicted in FIGS. 12-14, in which the various elements of tensile member 80 are joined by a plurality of links 84. As discussed above, the various elements of tensile member 80 may form areas of chamber 60 that are in fluid communication with each other. Links 84 define various fluid passages between areas of chamber 80. Although each of the elements of tensile member 80 may be joined by links 84, FIGS. 12-14 depict a configuration wherein the elements of tensile member 80 in each of regions 11-13 are not joined by links. This configuration permits, for example, the fluid pressure to vary between each of regions 11-13.

An advantage to links 84 relates to manufacturing efficiency. When tensile member 80 is formed from a plurality of separate elements, as in FIGS. 8-11D, each of the elements must be properly positioned with respect to barrier layers 71 and 72. Links 84 effectively join the elements of tensile member 80 together to form a larger element that may be positioned more easily than a plurality of smaller elements.

The specific structure of chamber 60 is discussed above and depicted in the figures may vary significantly, For example, chamber 60 is disclosed as including a textile tensile member 80. In some embodiments, tensile member 80 may be formed from a foam material, or tensile member 80 may be absent. Although forming bonds between barrier layers 71 and 72 is an effective manner of forming a flexion zone in chamber 60, flexion bonds 74 may be absent in some embodiments. That is, the flexion zone in chamber 60 may be formed by unbonded portions of layers 71 and 72. Accordingly, chamber 60 may depart from the structure disclosed above within the scope of aspects of the present invention.

Figure 15:
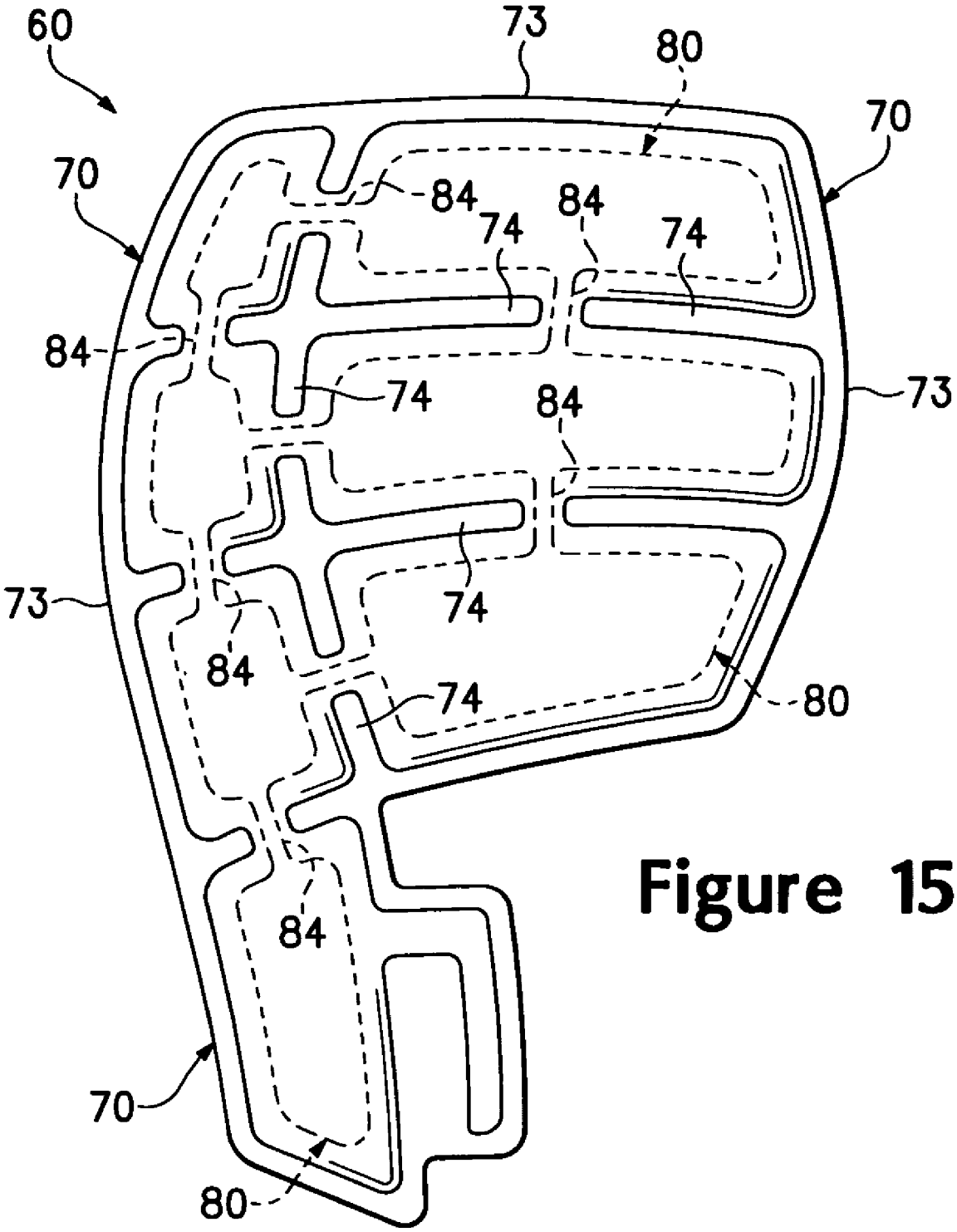
FIG. 15 is a top plan view of another chamber configuration.

Chamber 60, as discussed above, extends through substantially all of a longitudinal length of footwear 10. In some embodiments, however, chamber 60 may be limited to one of regions 11-13 or one of sides 14-15, for example. Alternately, chamber 60 may extend through only two of regions 11-13. With reference to FIG. 15, chamber 60 is depicted as having a configuration that would be primarily located in forefoot region 11 and portions of midfoot region 12.

Figure 16:
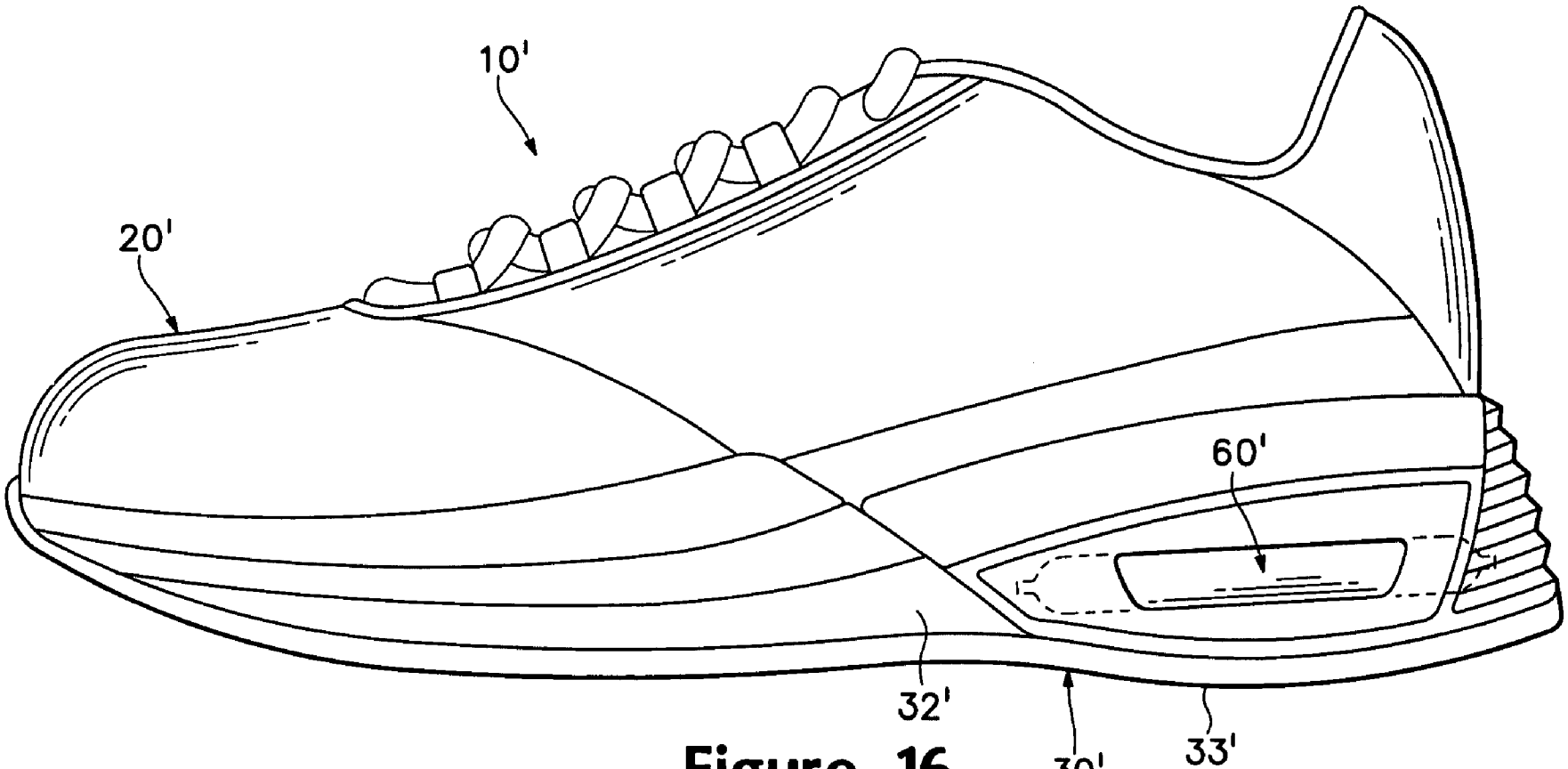
FIG. 16 is a lateral elevational view of an article of footwear with a fourth sole structure.
Figure 17:
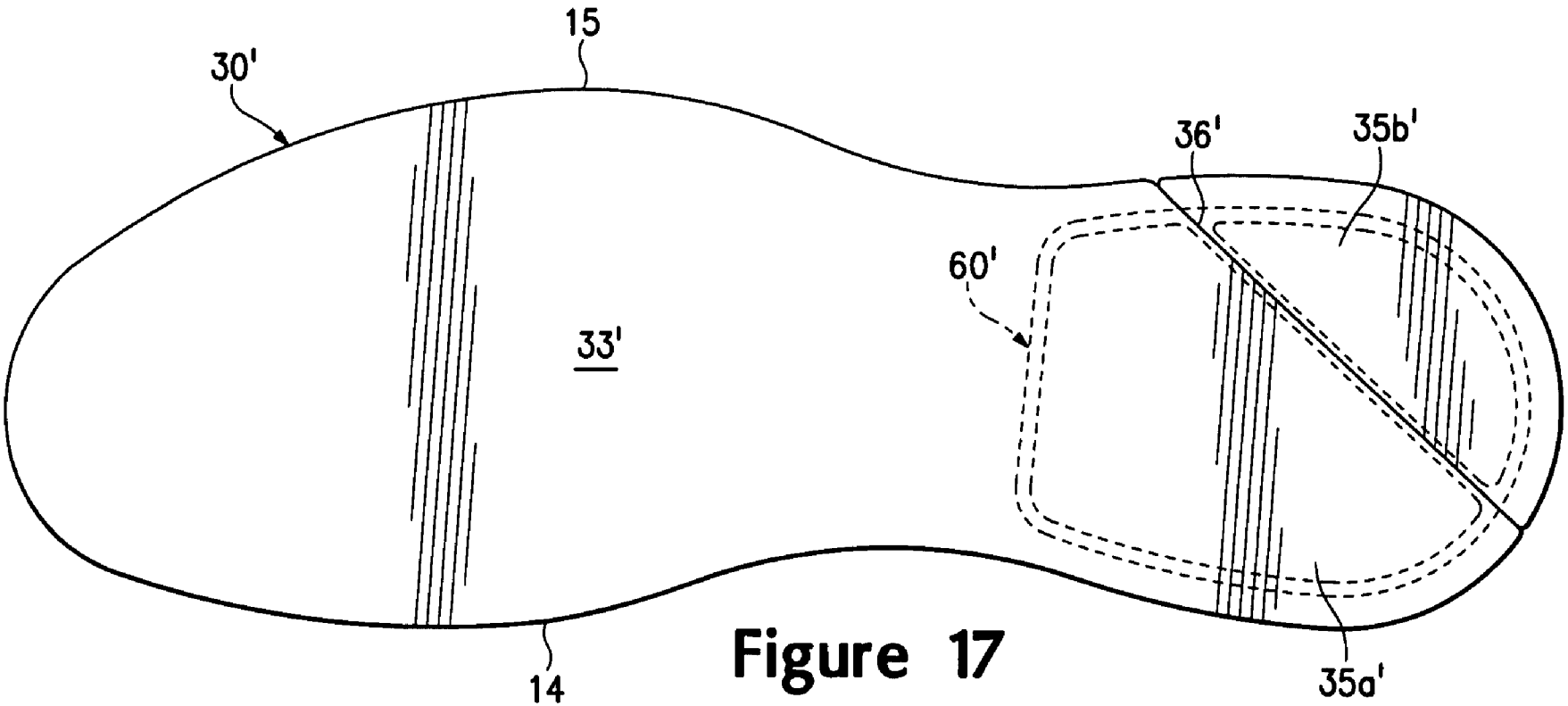
FIG. 17 is a schematic bottom plan view of the fourth sole structure.
Figure 18:
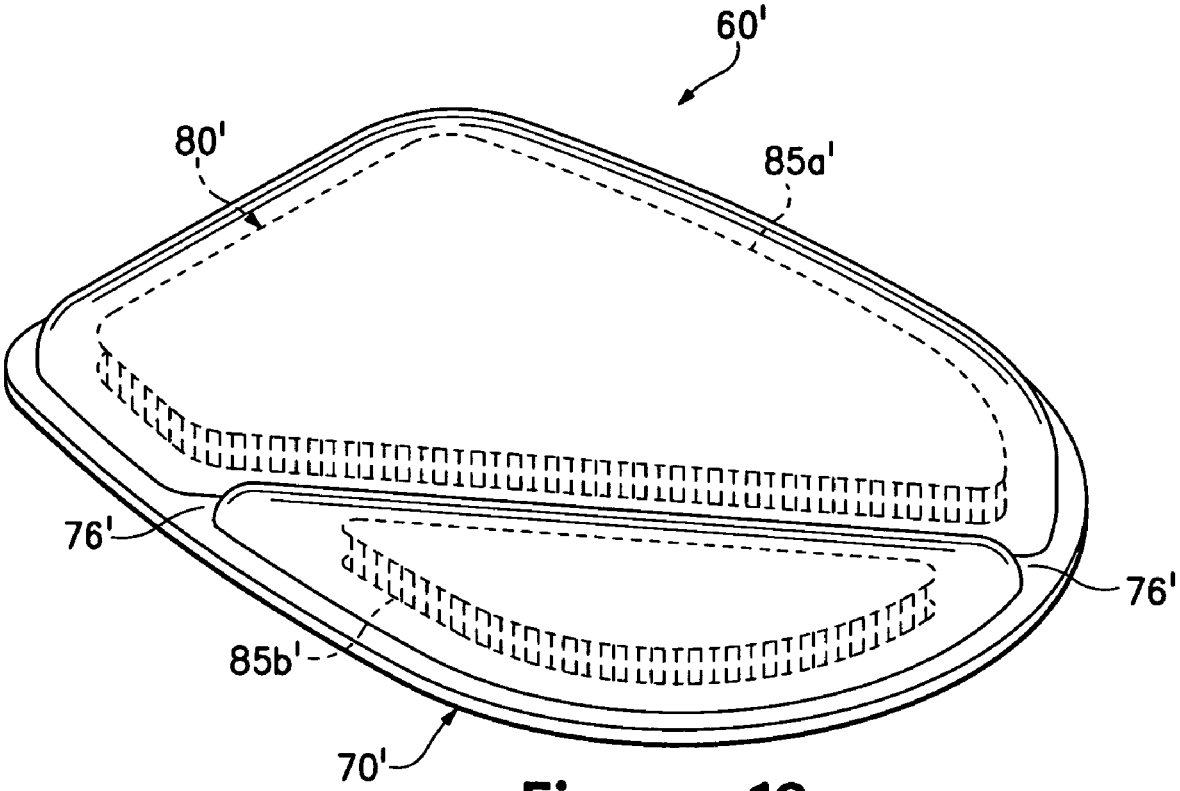
FIG. 18 is a perspective view of a fluid-filled chamber of the fourth sole structure.
Figure 19:
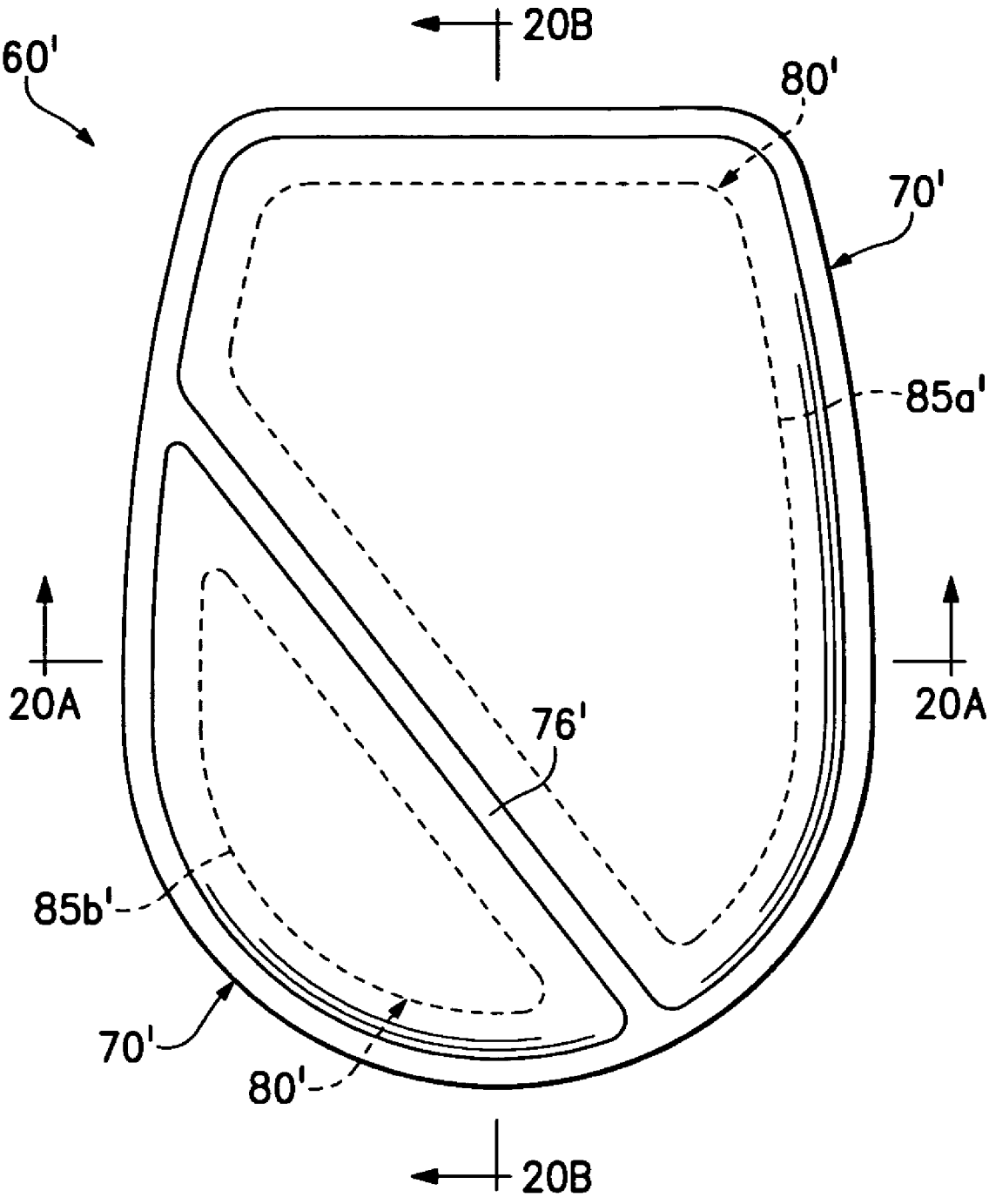
FIG. 19 is a top plan view of the chamber.
Figure 20A:
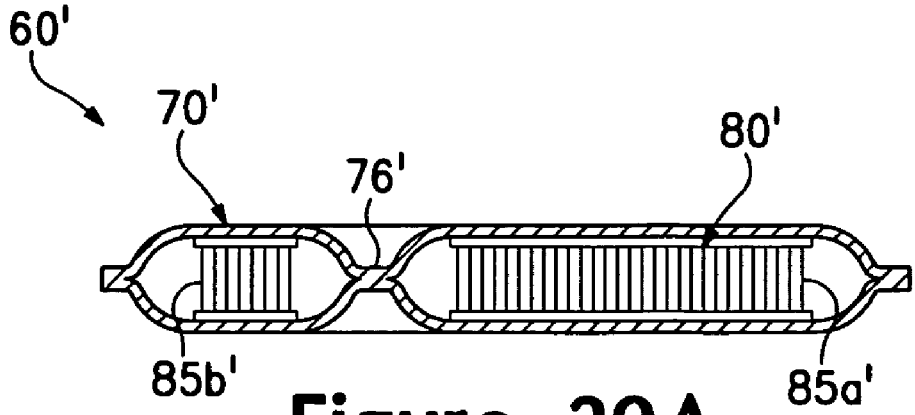
FIGS. 20A and 20B are cross-sectional views of the chamber, as defined by section lines 20A and 20B in FIG. 19.
Figure 20B:
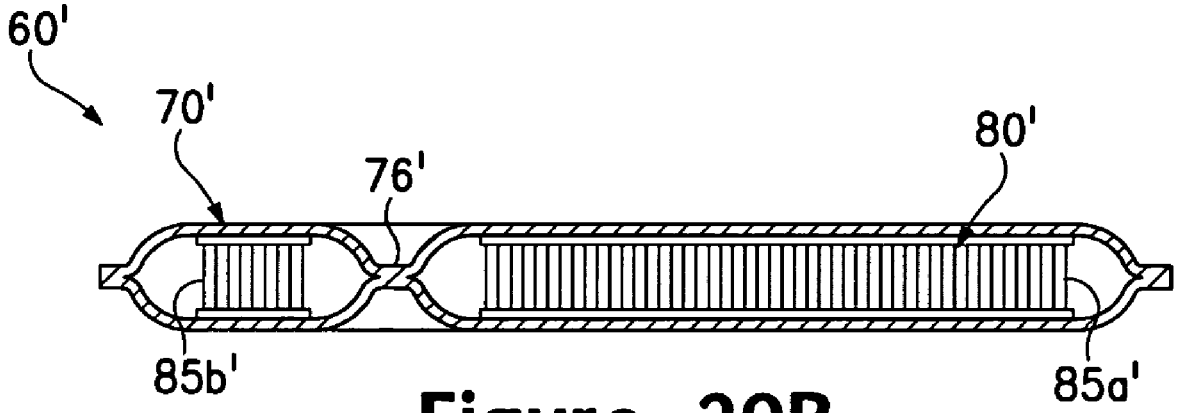

Another article of footwear 10' is depicted in FIG. 16 as having an upper 20' and a sole structure 30'. Upper 20' is secured to sole structure 30' and may have any conventional or non-conventional configuration. Sole structure 30' includes a midsole 32', an outsole 33', and a chamber 60'. Midsole 32' is at least partially formed from a polymer foam material, such as polyurethane or ethylvinylacetate, that at least partially includes chamber 60'. Midsole 32' includes a pair of areas 35*a*' and 35*b*' that are separated by a flexion line 36', as depicted in FIG. 17. Area 35*a*' forms a majority of midsole 32' and extends along substantially the entire length of midsole 32'. Area 35*b*' is located in a rear-lateral corner of midsole 32' and is positioned to contact the ground prior to a remainder of midsole 32' during running, for example. In comparison with the polymer foam material forming area 35*a*', the foam material of area 35*b*' may be less dense. Flexion line 36' separates areas 35*a*' and 35*b*' and forms a zone that permits area 35*b*' to rotate or otherwise flex relative to area 35*a'*.

Chamber 60', which is depicted in FIGS. 18-20B, is at least partially located within midsole 32' and includes an outer barrier 70' and a tensile member 80'. Barrier 70' may be formed of a polymer material that is substantially impermeable to a pressurized fluid contained by chamber 60'. Tensile member 80' is formed from a pair of elements 85*a*' and 85*b*' and may have a textile structure that is similar to tensile member 80. Elements 85*a*' and 85*b*' are spaced from each other, and a flexion bond 76' extends between elements 85*a*' and 85*b*'. Flexion bond 76' defines an area of flexion in chamber 60' and is formed as a bond between opposite surfaces of barrier 70'.

Chamber 60' is located in midsole 32' such that element 85*a*' is positioned in area 35*a*' and element 85*b*' is positioned in area 35*b*'. As noted above, flexion line 36' separates areas 35*a*' and 35*b*' and forms a zone that permits area 35*b*' to rotate or otherwise flex relative to area 35*a*'. Similarly, flexion bond 76' separates areas of chamber 60' and permits these areas to flex with respect to each other. Accordingly, flexion bond 76' is aligned with flex line 36' to facilitate flexing in sole structure 30'.

Figure 21:
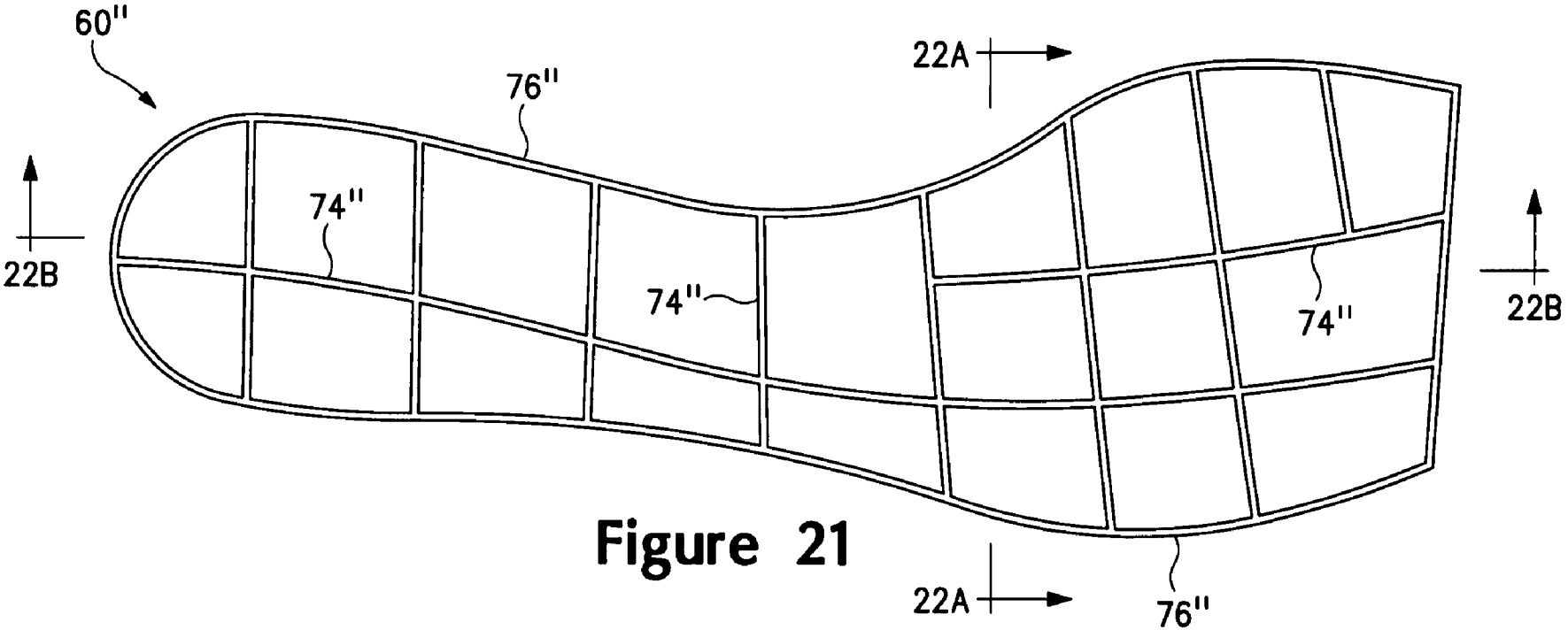
FIG. 21 is a top plan view of yet another chamber configuration.
Figure 22A:
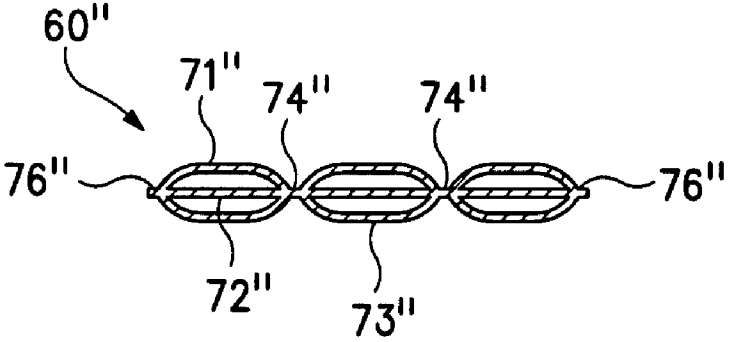
FIGS. 22A and 22B are cross-sectional views of the chamber, as defined by section lines 22A and 22B in FIG. 21.
Figure 22B:
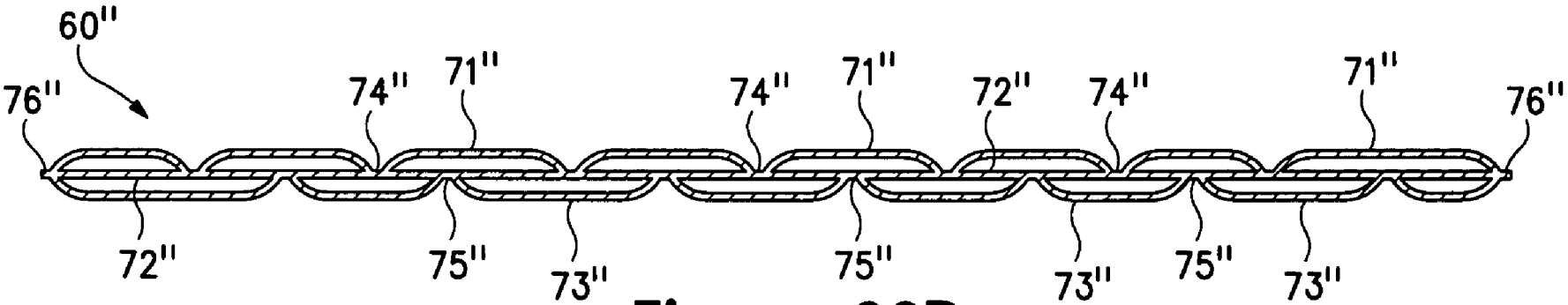

Chamber 60 and chamber 60' are discussed above and depicted in the figures as respectively including outer barrier 70 and outer barrier 70', each of which may be formed from two sheets of a polymer material. In some embodiments, the barrier of a chamber may be formed from three or more layers. With reference to FIGS. 21-22B, a chamber 60" is depicted as being formed from three coextensive barrier layers 71", 72", and 73". Barrier layers 71" and 72" are bonded to each other at various locations to define flexion bonds 74" with the general configuration of sipes 52*a*-52*l*. That is, when incorporated into midsole 32, for example, the various flexion bonds 74" will correspond in location to sipes 52*a*-52*l*. Barrier layers 72" and 73" are bonded to each other at various locations to define bonds 75", which are offset from flexion bonds 74", as depicted in the cross-sections of FIGS. 22A and 22B. Each of barrier layers 71"-73" are also bonded around the periphery of chamber 60" to form a peripheral bond 76"

Flexion bonds 74 of chamber 60 define areas where the entire thickness of chamber 60 is the bonded area between opposite sides of outer barrier 70. Flexion bonds 74 may define, therefore, areas of decreased ground reaction force attenuation. In chamber 60", however, the area between barrier layers 72" and 73" incorporate a fluid in the areas associated with flexion bonds 74". That is, areas of chamber 60" associated with flexion bonds 74" also impart ground reaction force attenuation due to the fluid-filled areas between barrier layers 72" and 73". In some configurations, all three of barrier layers 71"-73" may be bonded in locations corresponding with sipes 52*a*-52*l* to impart greater flexibility, and other bonds may be offset to enhance ground reaction force attenuation.

Chamber 60" is depicted as forming flexion bonds 74" between barrier layers 71" and 72". In some embodiments, bonds 75" may correspond in location to sipes 52*a*-52*l*, or a combination of flexion bonds 74" and 75" may correspond in location to sipes 52*a*-52*l*. That is, chamber 60" may have a variety of configurations that impart flexion corresponding with flexion zones in the sole structure.

Figure 23:
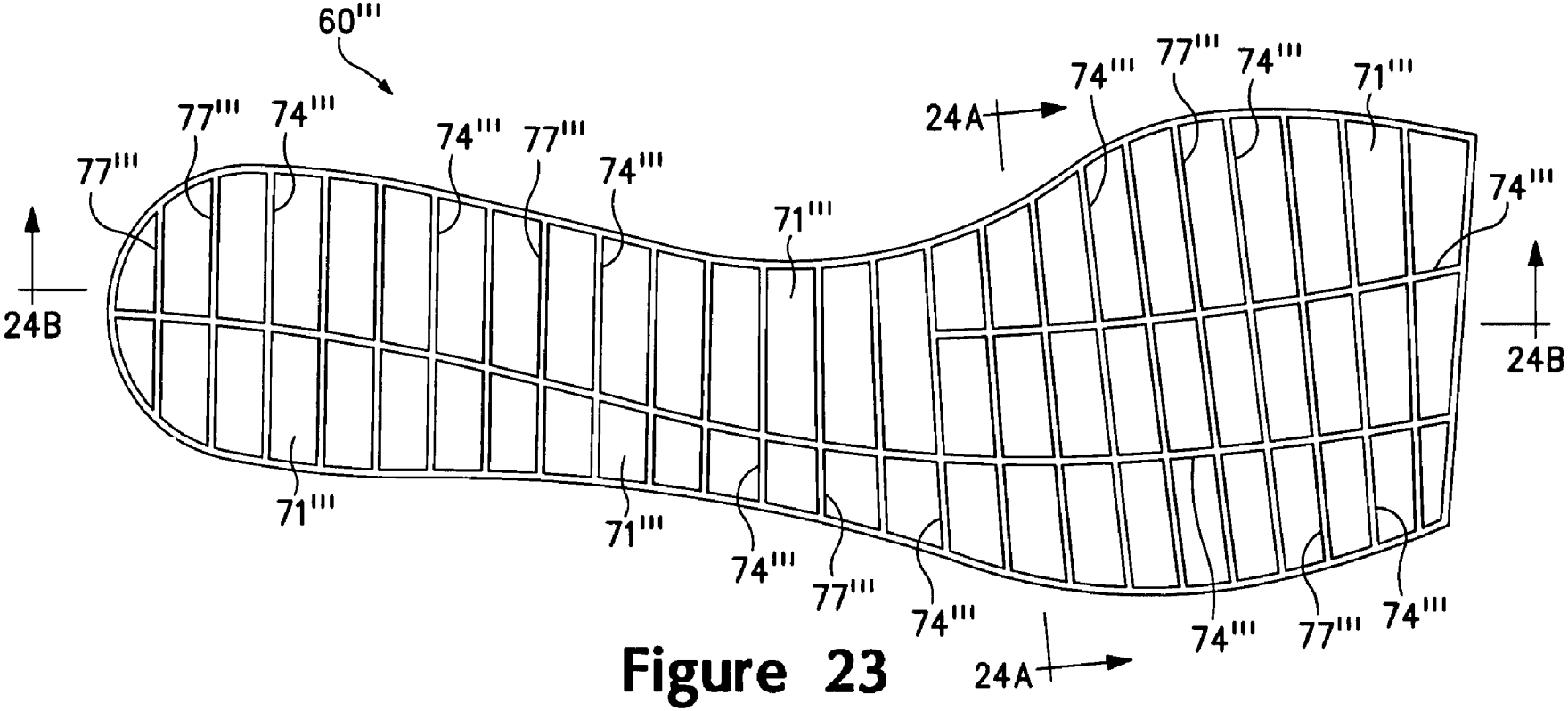
FIG. 23 is a top plan view of another chamber configuration.
Figure 24A:
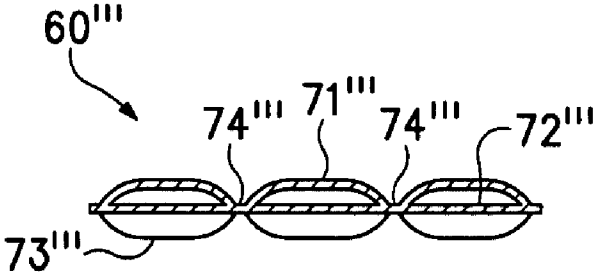
FIGS. 24A and 24B are cross-sectional views of the chamber, as defined by section lines 24A and 24B in FIG. 23.
Figure 24B:
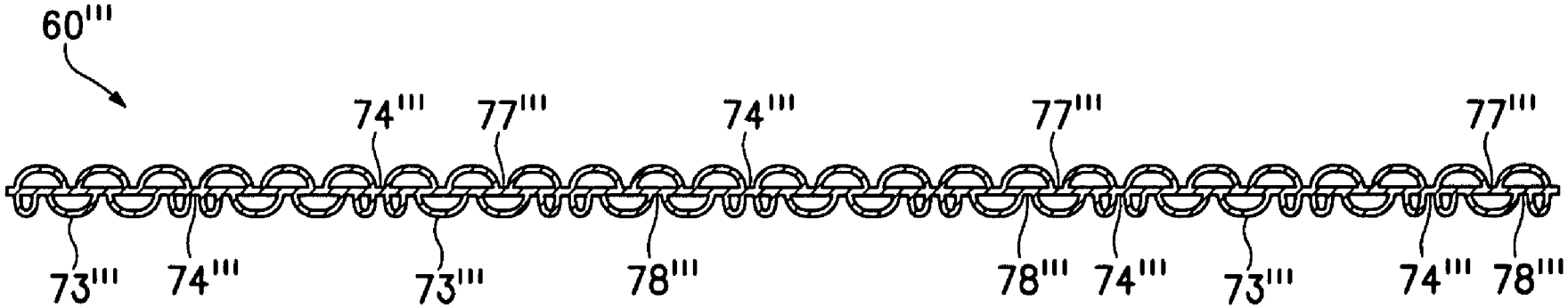
Figure 25:
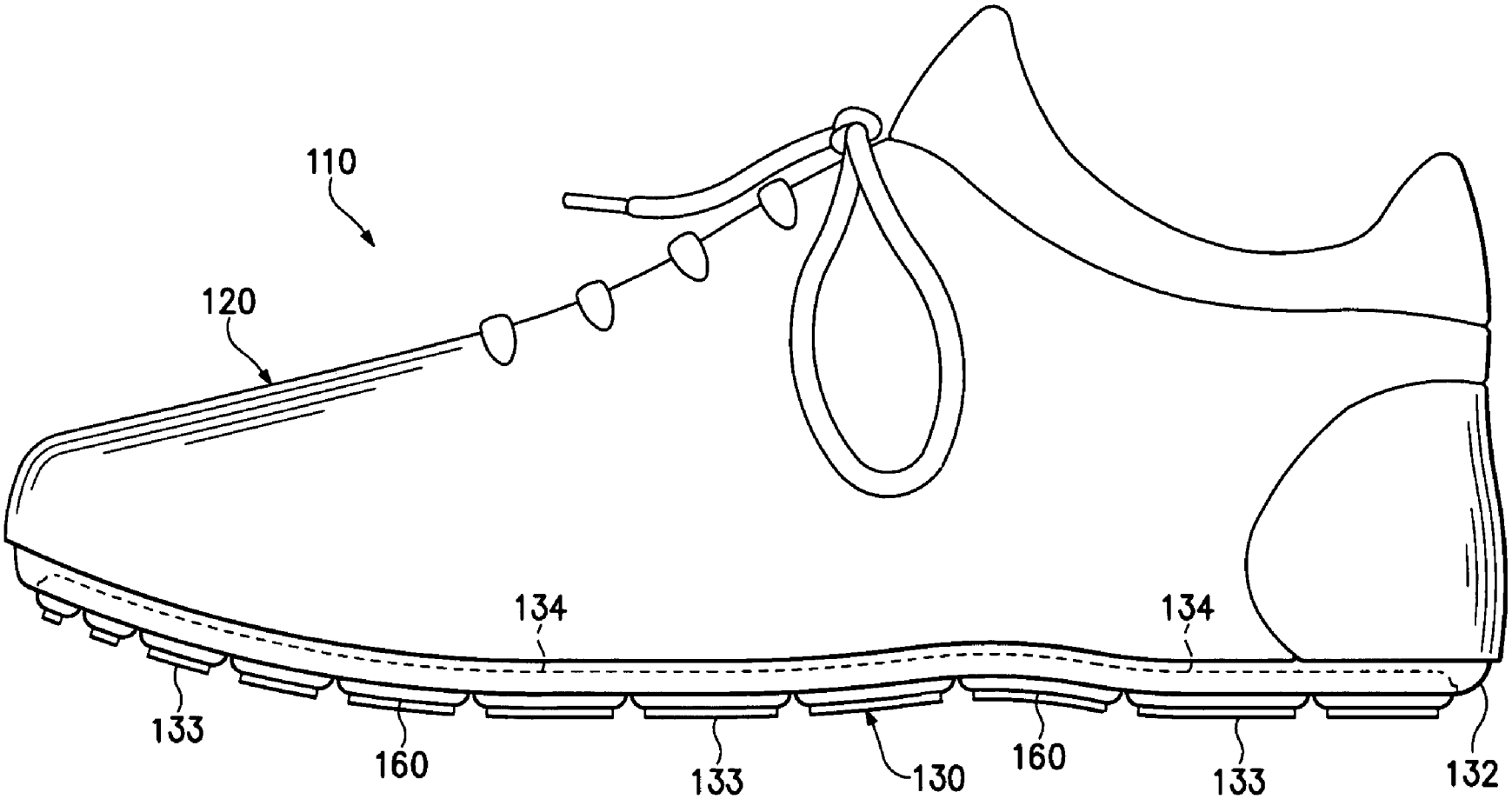
FIG. 25 is a lateral side elevational view of an article of footwear with a fifth sole structure.
Figure 26:
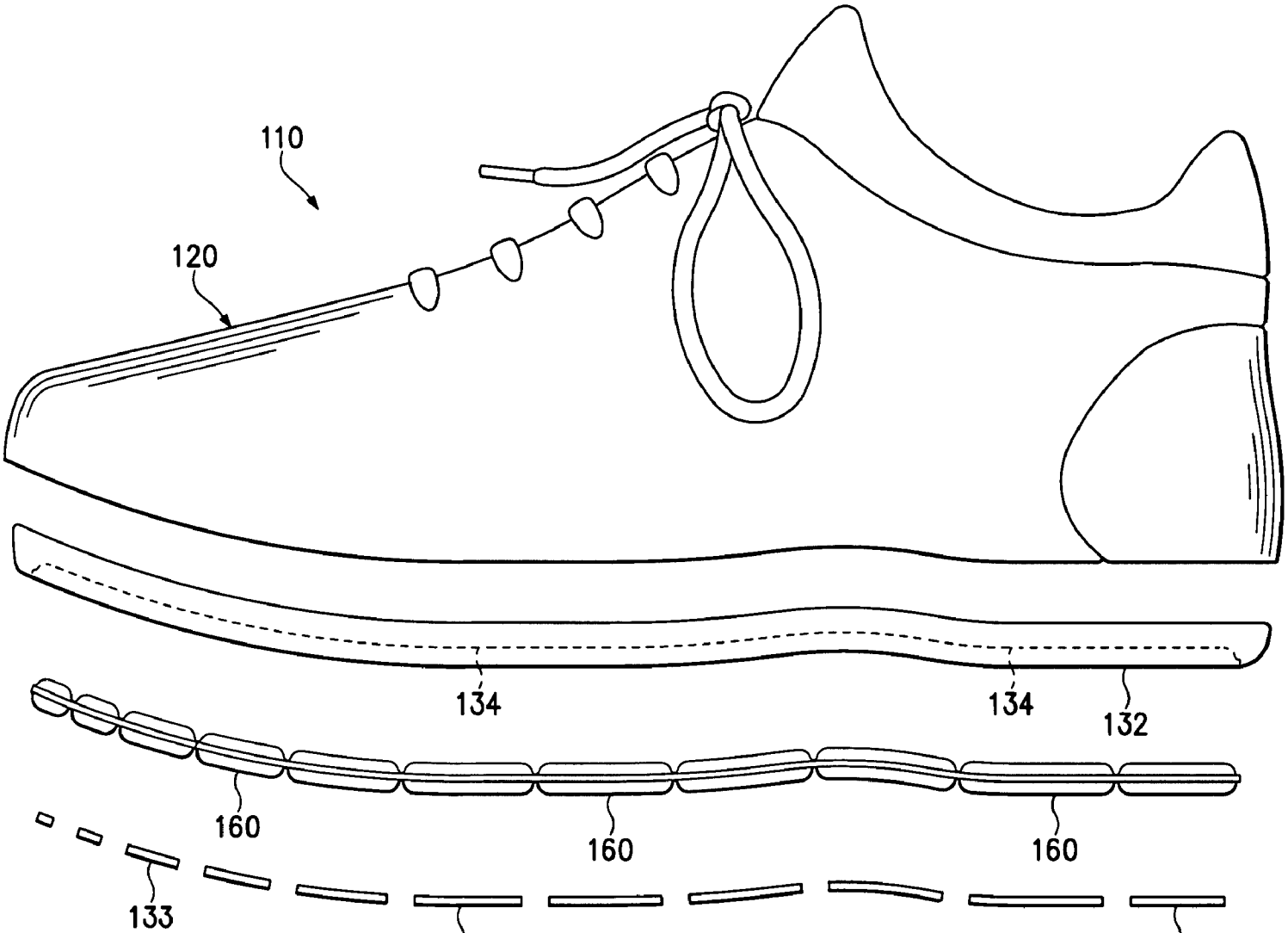
FIG. 26 is an exploded lateral side view of the article of footwear having the fifth sole structure.
Figure 27:
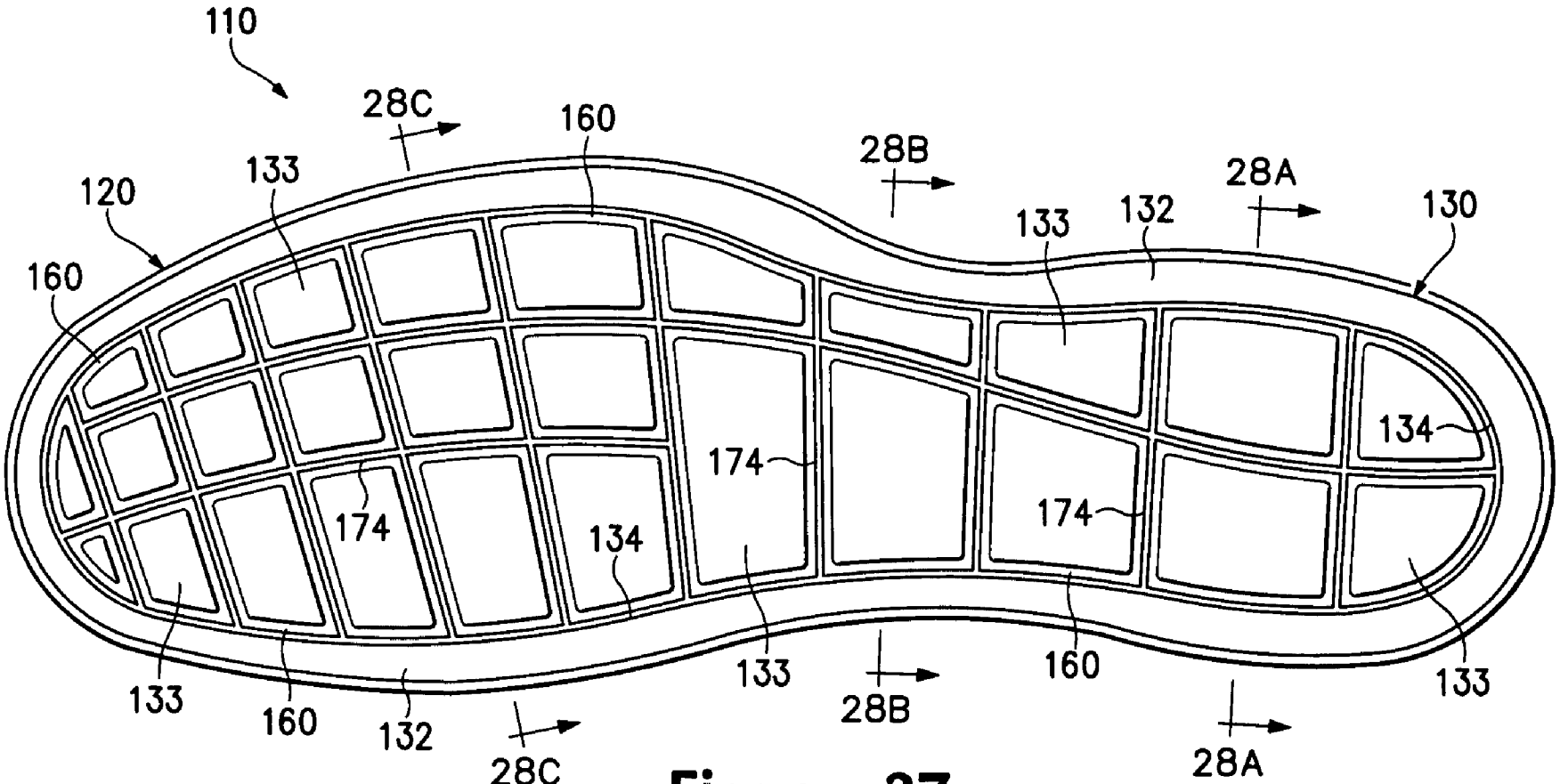
FIG. 27 is bottom plan view of the article of footwear having the fifth sole structure.
Figure 28A:
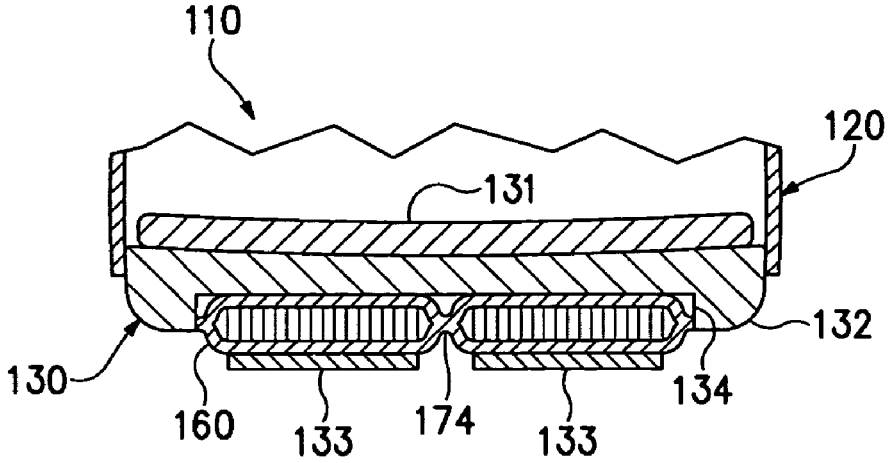
FIGS. 28A-28C are cross-sectional views of the footwear having the fifth sole structure, as defined by section lines 28A and 28B in FIG. 27.
Figure 28B:
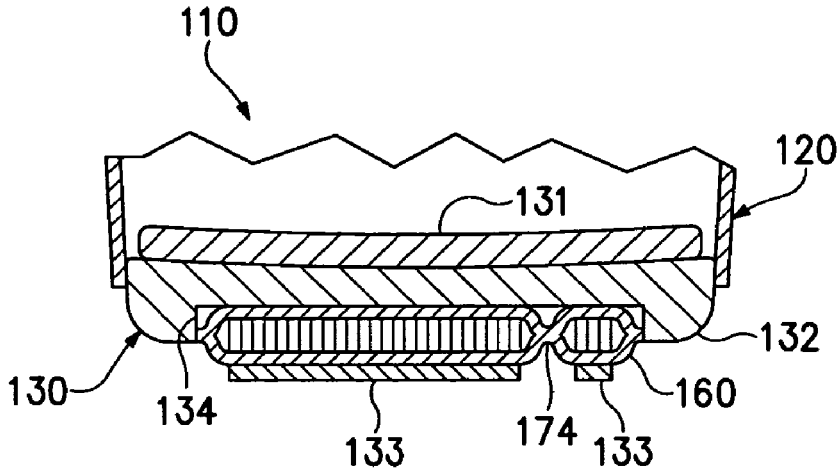
Figure 28C:
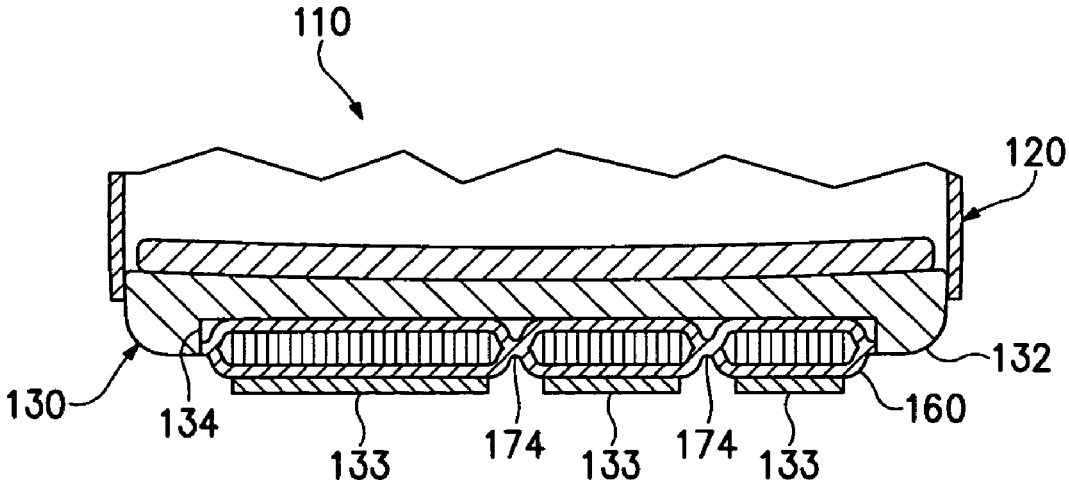

Another embodiment where the barrier of a chamber is formed from three or more layers is depicted in FIGS. 23-24B as a chamber 60''', which is formed from three coextensive barrier layers 71''', 72''', and 73'''. Barrier layers 71''' and 72''' are bonded to each other at various locations to define a plurality of laterally-extending bonds 77'''. Similarly, barrier layers 72''' and 73''' are bonded to each other at various locations to define a plurality of laterally-extending bonds 78''' that are offset from bonds 77'''. At various locations having the general configuration of sipes 52*a*-52*l*, all three barrier layers 71''', 72''', and 73''' are bonded together to define a plurality of flexion bonds 74'''. That is, when incorporated into midsole 32, for example, the various flexion bonds 74''' will correspond in location to sipes 52*a*-52*l*.

Based upon the above discussion, fluid-filled chambers may define various flexion zones that facilitate bending or flexing of the chambers. A sole structure may also incorporate a flexion zone, and the flexion zone of the chamber may be positioned to correspond with the flexion zone of the sole structure to enhance the overall flexibility of the sole structure. Flexion zones in a chamber may be formed as bonds between opposite surfaces or as areas where a tensile member or other element is absent.

Another article of footwear 110, as depicted in FIGS. 25-28C, includes an upper 120 and a sole structure 130. Upper 120 is formed from various material elements that are stitched or adhesively-bonded together to form an interior void that comfortably receives a foot and secures the position of the foot relative to sole structure 30. A variety of materials are suitable for upper 120, including any of the materials that are discussed above for upper 20 and upper 20'. Additionally, any of a plurality of conventional or non-conventional structures may be utilized for upper 120. Sole structure 130 is secured to a lower portion of upper 120 and provides a durable, wear-resistant component for attenuating ground reaction forces as footwear 110 impacts the ground.

Figure 8:
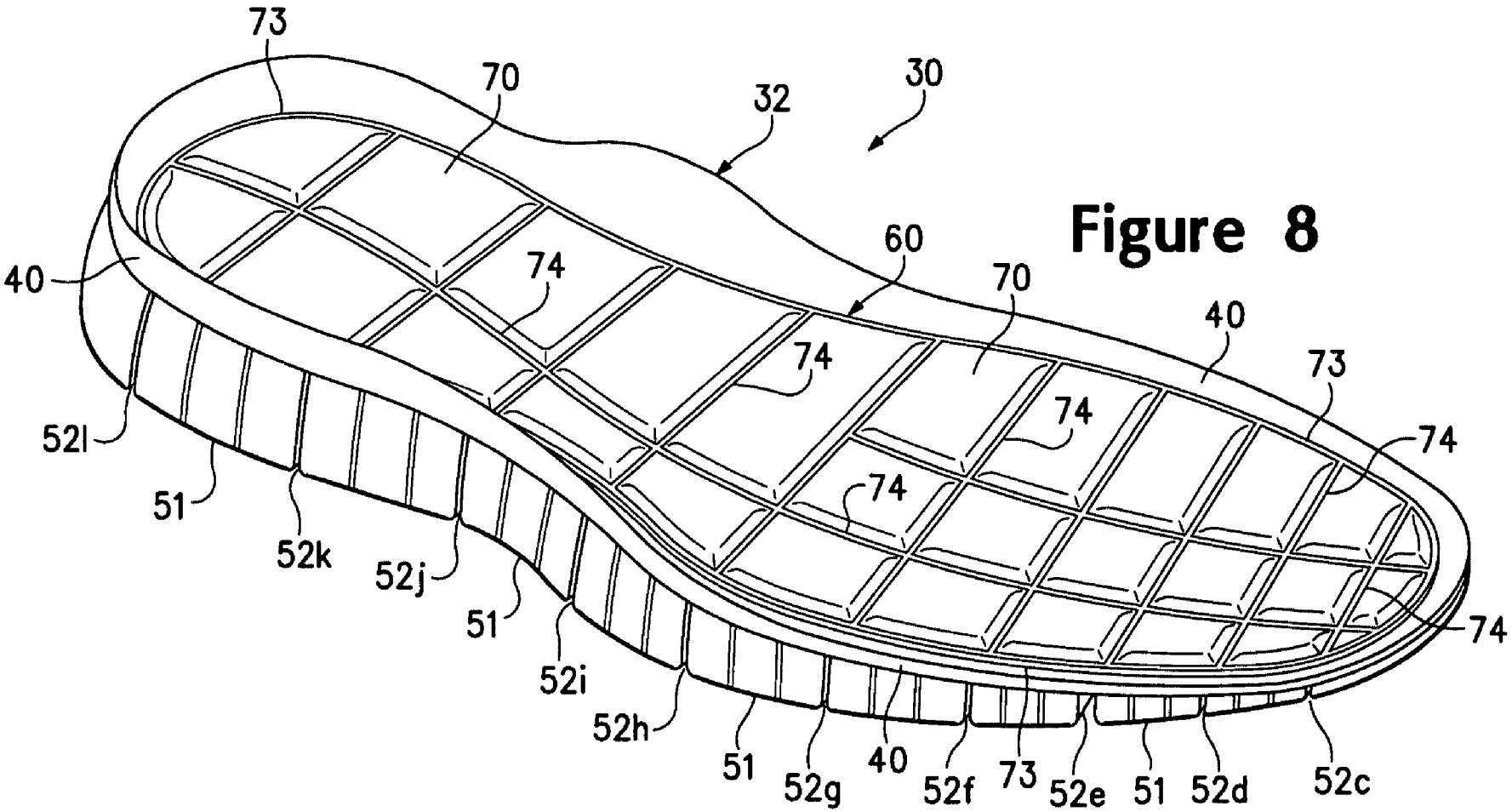
FIG. 8 is a perspective view of a second sole structure.
Figure 9:
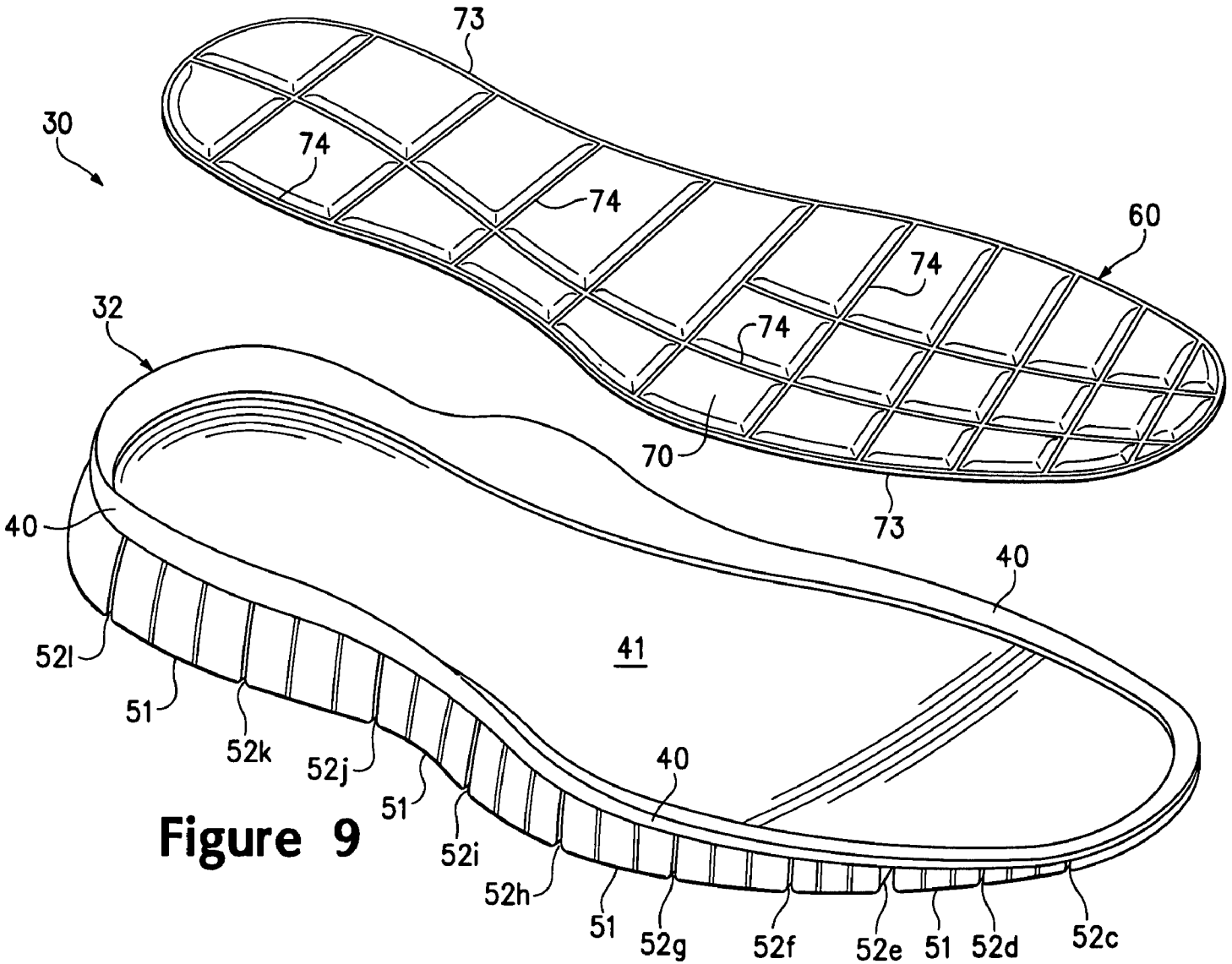
FIG. 9 is an exploded perspective view of the second sole structure.
Figure 10:
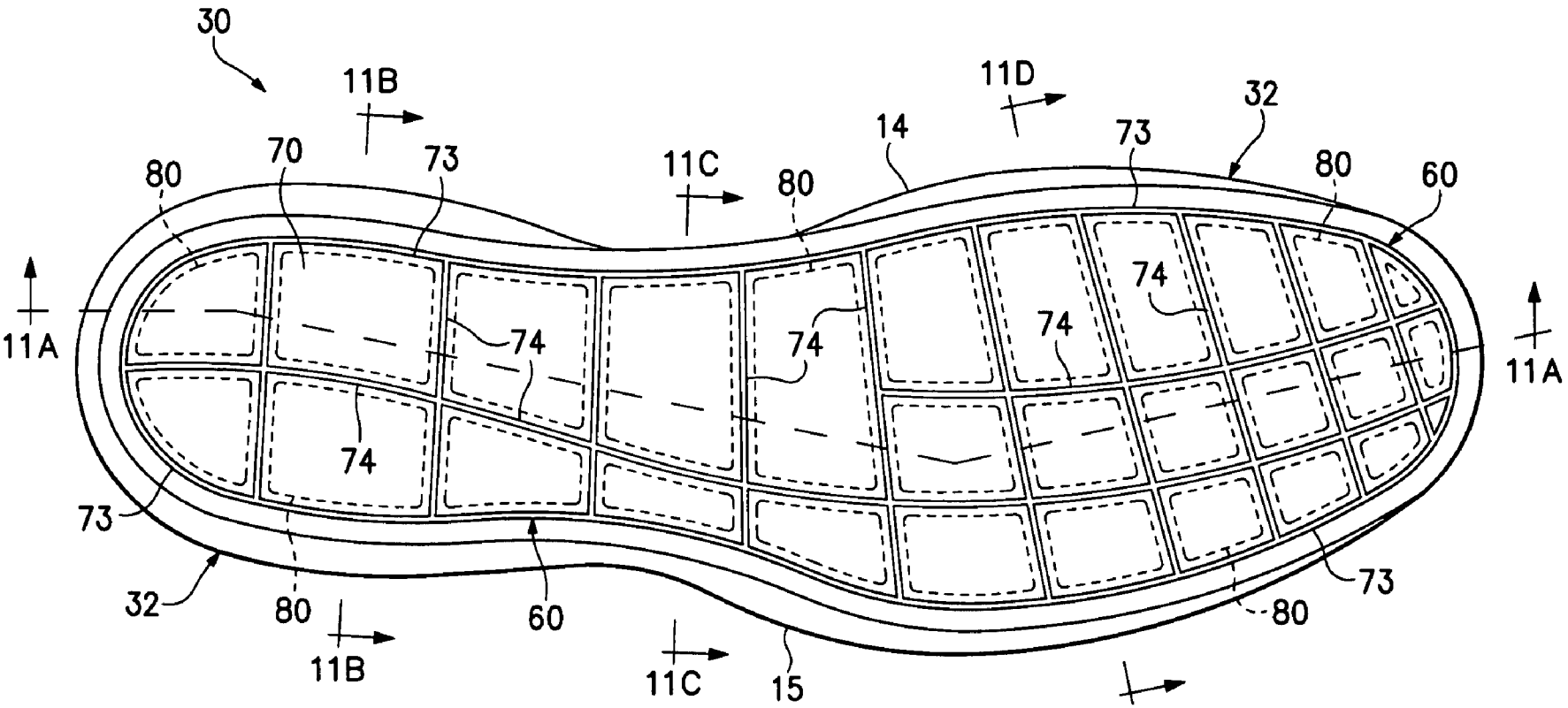
FIG. 10 is a top plan view of the second sole structure.
Figure 11A:
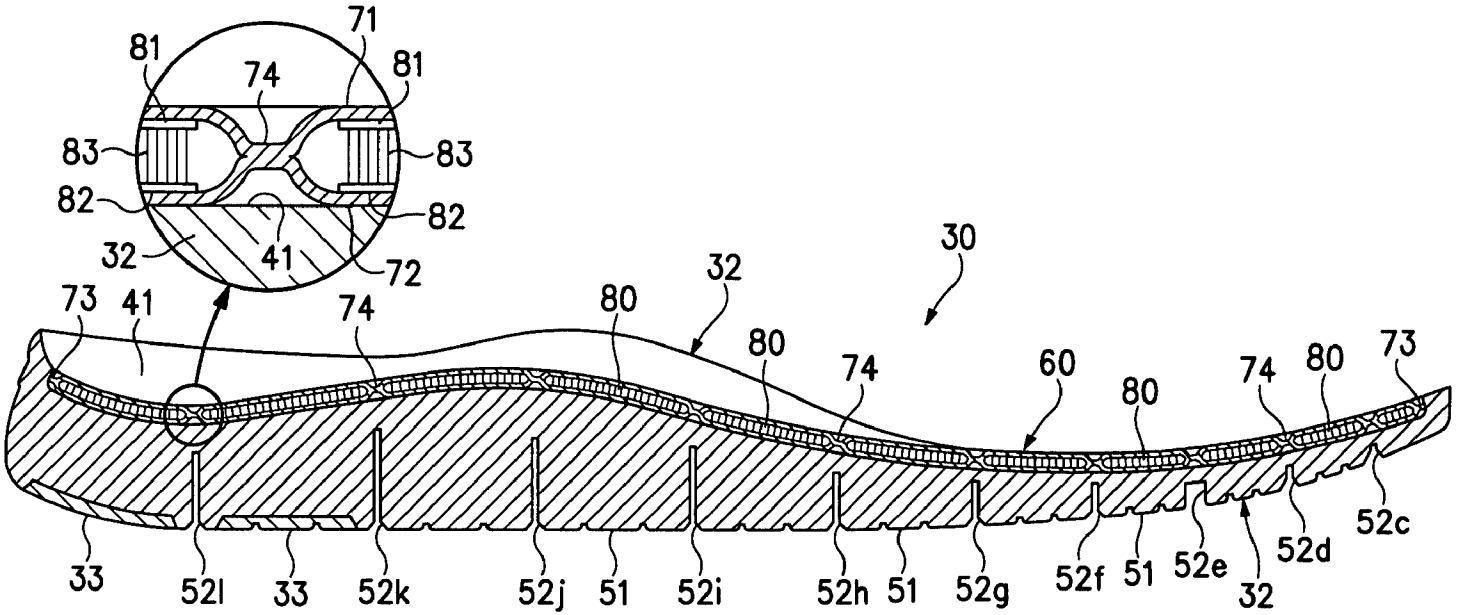
FIGS. 11A-11D are cross-sectional views of the second sole structure, as defined by section lines 11A-11D in FIG. 10.
Figure 11B:
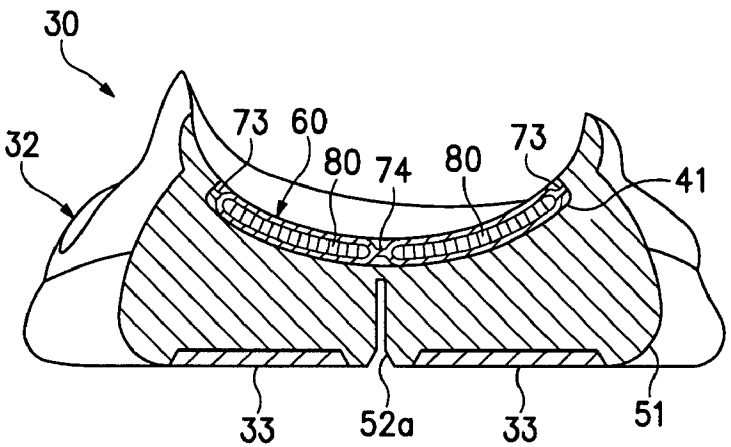
Figure 11C:
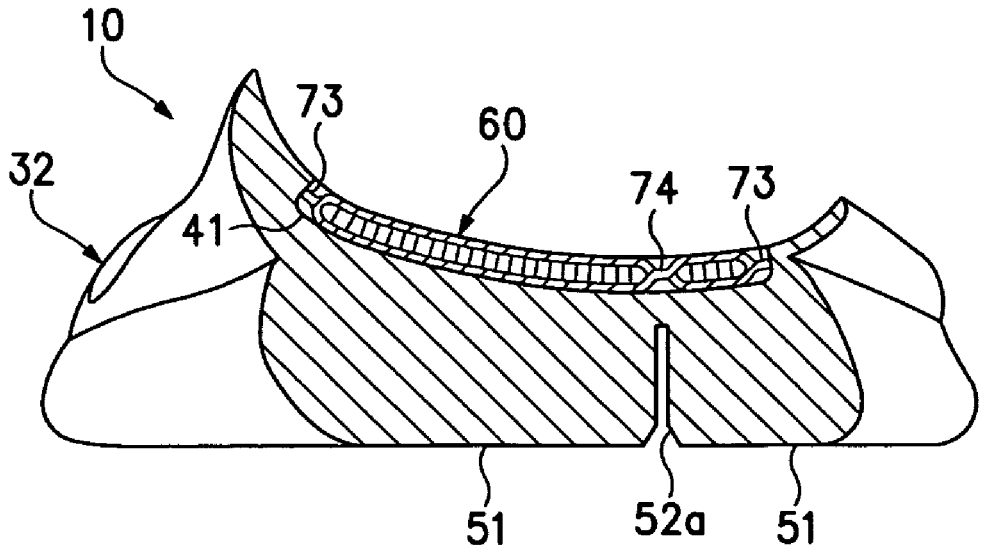
Figure 11D:
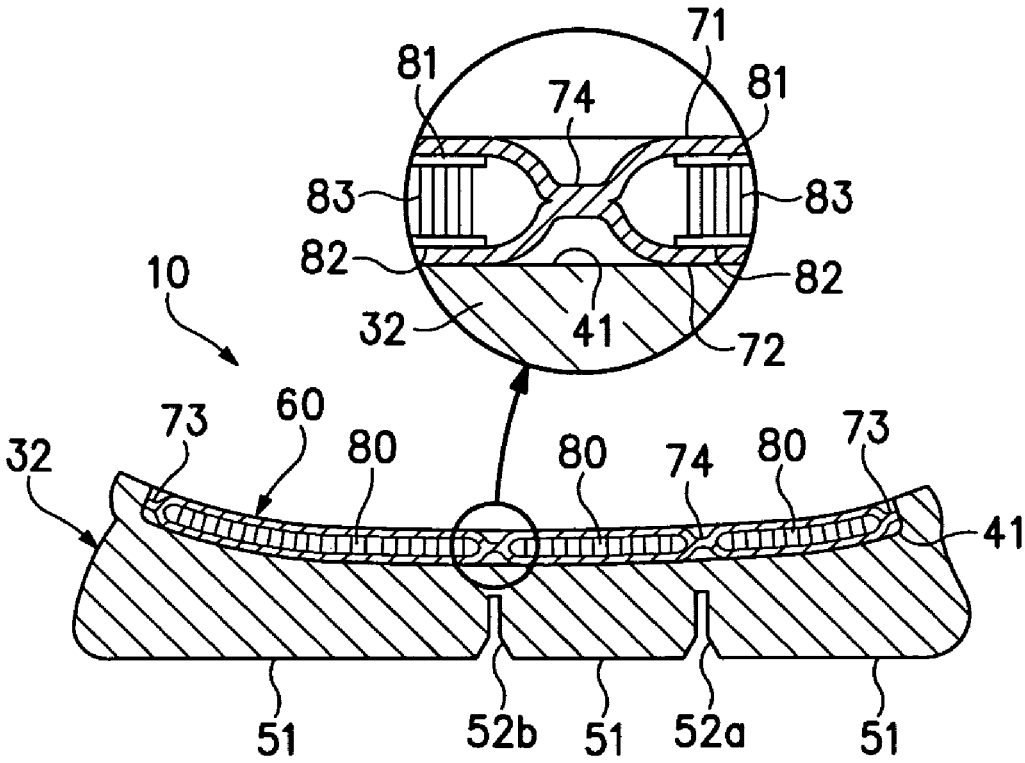

Sole structure 130 includes an insole 131, a midsole 132, an outsole 133, and a chamber 160, which is depicted as having the configuration of chamber 60 from FIGS. 8-10 for purposes of example. Insole 131 is positioned within upper 20 and is positioned to contact the plantar (lower) surface of the foot and enhance the comfort of footwear 110. Midsole 132 is secured to a lower portion of upper 120 and is positioned to extend under the foot during use. Among other purposes, midsole 32 attenuates ground reaction forces when walking or running, for example Suitable materials for midsole 132 are any of the polymer foams discussed above for midsole 32. A lower surface of midsole 132 defines a depression 134 that receives chamber 160. Accordingly, chamber 160 may be secured within depression 134. In some configurations of footwear 110, insole 131 may be absent such that the foot (or sock covering the foot) rests upon an upper surface of midsole 132 or a covering (e.g., a textile or flocked material) that is bonded to the upper surface of midsole 132.

Outsole 133 is secured to a lower surface of chamber 160 to provide a ground-contacting surface of footwear 110. Although outsole 133 may extend throughout the lower surface of chamber 160, outsole 133 is depicted as having a plurality discrete sections that are bonded or otherwise secured to areas of chamber 160. Suitable materials for outsole 133 include any of the conventional rubber materials that are utilized in footwear outsoles, such as carbon black rubber compound. Although outsole 133 covers a substantial area of the lower surface of chamber 160, portions of chamber 160 are exposed between the sections of outsole 133. Accordingly, portions of chamber 160 may also provide a portion of the ground-contacting surface of footwear 110.

Figure 29A:
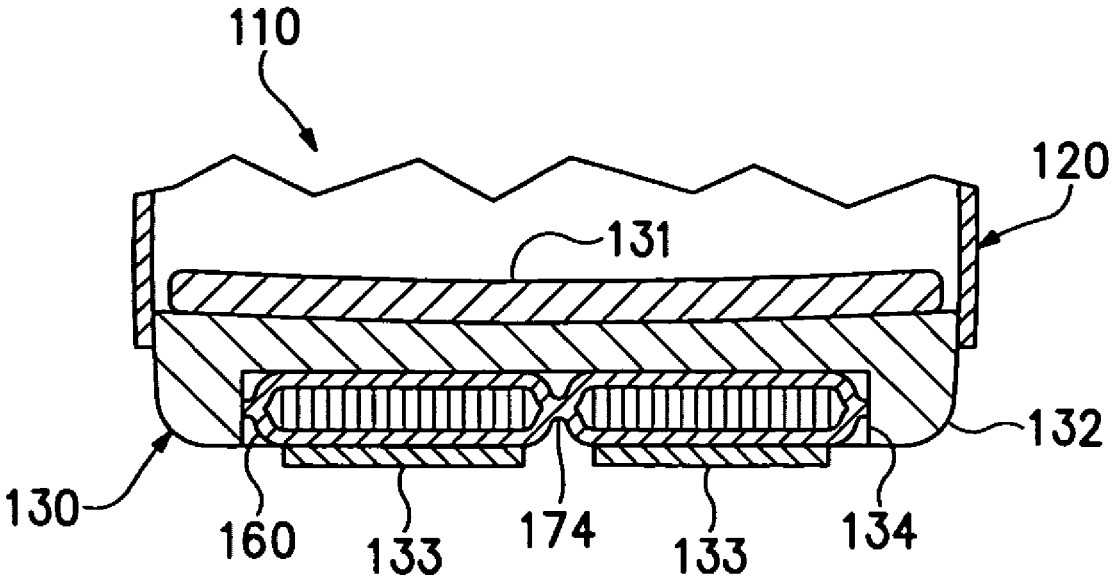
FIGS. 29A-29D are cross-sectional views corresponding with FIG. 28A and depicting alternate configurations for the fifth sole structure.
Figure 29B:
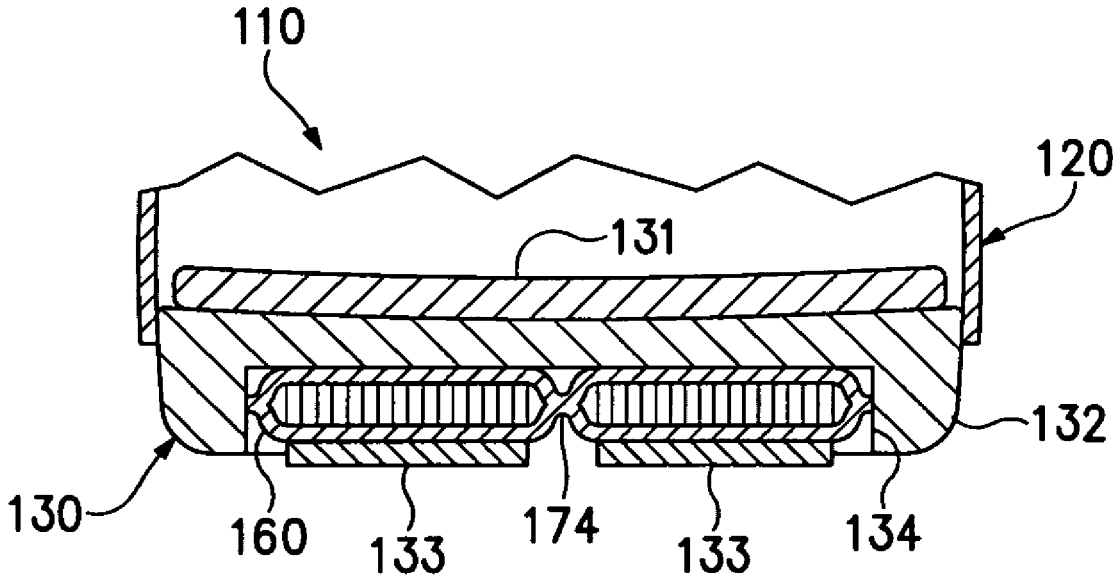
Figure 29C:
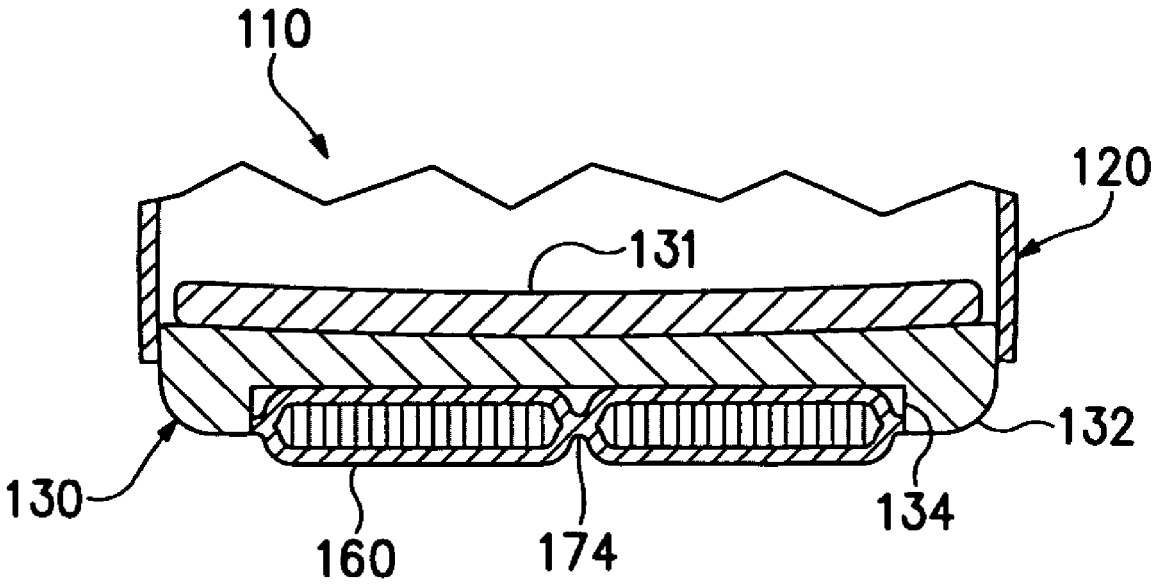
Figure 29D:
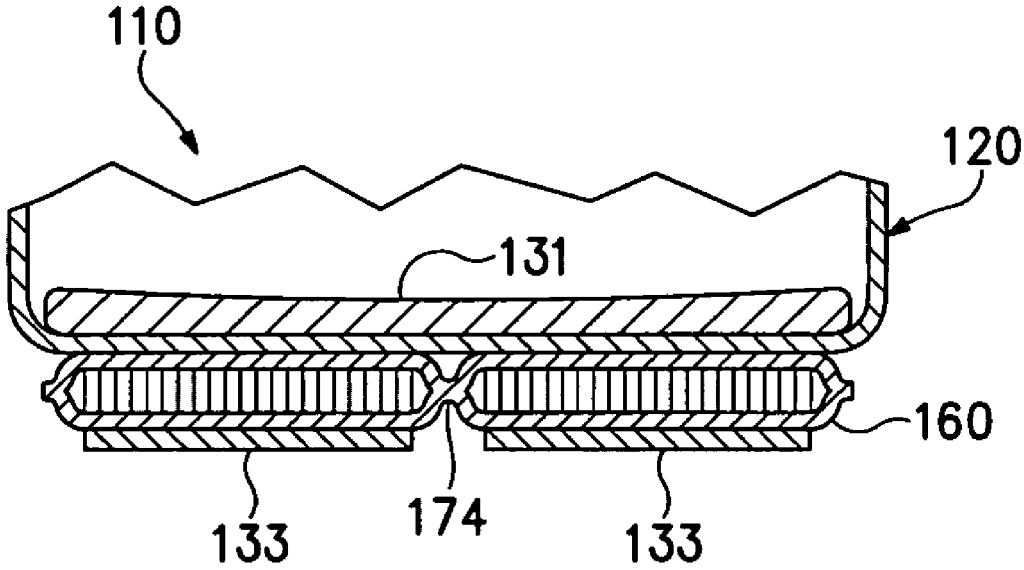

Chamber 160 supplements the ground reaction force attenuation properties of midsole 132. As depicted in FIGS. 25 and 27-28C, chamber 160 extends beyond the lower surface of midsole 132. That is, the thickness of chamber 160 is greater than the depth of depression 134 so that a lower portion of chamber 160 protrudes outward from depression 134. In some configurations, chamber 160 may be flush with the lower surface of midsole 132 (see FIG. 29A), or chamber 160 may be entirely within depression 134 (see FIG. 29B). As further alternatives, outsole 133 may be absent such that the lower surface of chamber 160 forms the ground-contacting surface of footwear 110 (see FIG. 29C), or midsole 132 may be absent such that chamber 160 is secured directly to upper 120 (see FIG. 29D). In yet further configurations, both midsole 132 and outsole 133 may be absent from footwear 110.

Chamber 160 includes various flexion lines 174 where opposite sides of the barrier material forming chamber 160 are bonded together. An advantage of flexion lines 174 is that chamber 160 tends to flex or otherwise bend along the various lines defined by flexion lines 174. That is, flexion lines 174 form an area of chamber 160 that is more flexible than other areas of chamber 160. Given that (a) outsole 133 is absent in areas corresponding with flexion lines 174 and (b) the areas of chamber 160 having flexion lines 174 are more flexible than other areas, flexion lines 174 provide flexion lines along which sole structure 130 bends or otherwise flexes during use. Chamber 160 may be utilized, therefore, to control the degree of flex in various areas of sole structure 130. As with midsole 32 described above, the flexible structure of chamber 160 is configured to complement the natural motion of the foot during running or other activities, and may impart a feeling or sensation of barefoot running. In contrast with barefoot running, however, the combination of midsole 132 and chamber 160 may attenuate ground reaction forces to decrease the overall stress upon the foot.

Whereas flexion lines 174 are discussed above and depicted as areas where opposite sides of the barrier material forming chamber 160 are bonded together, flexion lines 174 may be considered to be areas where chamber 160 has greater flexibility than other areas. Flexion lines 174 may be, therefore, areas where a tensile member within chamber 160 is absent or areas where chamber 160 has lesser thickness than other areas. Flexion lines 174 may also be merely areas where outsole 133 is absent to promote flexion or bending in areas between the discrete sections of outsole 133.

Although chamber 160 is depicted as having the configuration of chamber 60 from FIGS. 8-10, chamber 160 may also have the configuration of chamber 60 from any of FIGS. 12-14, the variation of chamber 60 from FIG. 15, chamber 60' from FIGS. 16-19, chamber 60" from FIG. 21, or chamber 60''' from FIG. 23. Accordingly, chamber 160 may extend through substantially all of the length of footwear 110 or only partially through the length of footwear 110. Chamber 160 may include a tensile member or have a configuration wherein a tensile member is absent. In addition, chamber 160 may have intercommunicating sub-chambers or sub-chambers that are isolated from fluid communication with each other. Chamber 160 is also depicted as extending across substantially all of a width of footwear 110, but may extend across only a portion of the width of footwear 110 in other configurations.

Chamber 160 is disclosed as a single footwear component that extends from a forefoot to a heel area of footwear 110. In some configurations, chamber 160 may be cut at the various flexion lines 174 to enhance the overall flexibility of sole structure 130. Alternately, chamber 160 may be two or more separate chambers that are secured to midsole 132.

The manufacturing method for footwear 110 may involve making each of midsole 132 and chamber 160 separately and then joining midsole 132 and chamber 160 with an adhesive or through thermobonding. As an alternative, chamber 160 may be located within a mold having a shape of midsole 132. As polymer material is injected into the mold, the polymer material extends around and partially encapsulates chamber 160, thereby embedding chamber 160 within midsole 132. An advantage to locating chamber 160 within the mold is that footwear 110 requires fewer adhesives or other bonding agents.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of footwear having an upper and a sole structure secured to the upper, the sole structure comprising:

a midsole element having an upper surface and an opposite lower surface, the upper surface being positioned adjacent the upper, and the lower surface defining an indentation extending upward and into the midsole element;

a chamber that encloses a fluid and is secured within the indentation of the lower surface of the midsole element, the chamber defining:

a plurality of lateral bond lines extending across a width of the chamber and preventing the fluid from passing in a longitudinal direction through the chamber, and at least one longitudinal flexion line extending along at least a portion of a longitudinal length of the chamber and preventing the fluid from passing in a lateral direction through the chamber; and an outsole secured to the chamber to form a ground-contacting surface of the footwear.

2. The article of footwear recited in claim 1, wherein the chamber extends outward from the indentation.

3. The article of footwear recited in claim 1, wherein the outsole includes a plurality of discrete outsole sections located between the bond lines.

4. An article of footwear having an upper and a sole structure secured to the upper, the sole structure comprising:

a midsole element having an upper surface and an opposite lower surface, the upper surface being positioned adjacent the upper;

a fluid-filled chamber secured to the lower surface of the midsole element, the chamber having a plurality of flexion bonds that extend between sub-chambers of the chamber and isolate the sub-chambers from fluid communication with each other; and an outsole secured to the chamber, the outsole including a plurality of outsole sections that are located between the flexion bonds, wherein both the chamber and the outsole form a ground-contacting surface of the footwear.

5. The article of footwear recited in claim 4, wherein the lower surface of the midsole element defines an indentation extending upward and into the midsole element, and the chamber is secured within the indentation.

6. The article of footwear recited in claim 5, wherein the chamber extends outward from the indentation.

7. The article of footwear recited in claim 4, wherein the flexion bonds include:

a plurality of lateral flexion bonds extending across a width of the chamber, and at least one longitudinal flexion bond extending along at least a portion of a longitudinal length of the chamber.

8. The article of footwear recited in claim 4, wherein the flexion bonds include:

a plurality of lateral flexion bonds extending across a width of the chamber, a first longitudinal flexion bond extending through a longitudinal length of the chamber, and a second longitudinal flexion bond extending through only a portion of the longitudinal length of the chamber.

9. An article of footwear having an upper and a sole structure secured to the upper, the sole structure comprising:

a midsole element having an upper surface an opposite lower surface, the upper surface being positioned adjacent the upper, and the lower surface defining a depression extending upward and into the midsole element;

a fluid-filled chamber secured within the depression and extending outward from the depression, the chamber enclosing a plurality of textile tensile members that are secured to opposite sides of the chamber, and the chamber including a plurality of flexion bonds where the opposite sides of the chamber are bonded to each other, the flexion bonds being located between the tensile members, and the flexion bonds including:

a plurality of lateral flexion bonds extending across a width of the chamber, and at least one longitudinal flexion bond extending along at least a portion of a longitudinal length of the chamber; and an outsole secured to a lower surface of the chamber, the outsole including a plurality of discrete outsole sections located between the flexion bonds.

10. The article of footwear recited in claim 9, wherein the flexion bonds define sub-chambers of the chamber.

11. The article of footwear recited in claim 9, wherein the sub-chambers are isolated from fluid communication with each other.

12. An article of footwear having an upper and a sole structure secured to the upper, the sole structure comprising:

a midsole element having an upper surface an opposite lower surface, the upper surface being positioned adjacent the upper;

a chamber that encloses a fluid and is secured to the lower surface of the midsole element, the chamber defining:

a plurality of lateral bond lines extending across a width of the chamber and preventing the fluid from passing in a longitudinal direction through the chamber, and at least one longitudinal flexion line extending along at least a portion of a longitudinal length of the chamber and preventing the fluid from passing in a lateral direction through the chamber; and an outsole secured to the chamber to form a ground-contacting surface of the footwear, the outsole including a plurality of discrete outsole sections located between the bond lines.

* * * * *